US011143977B2

(12) United States Patent
Salant et al.

(10) Patent No.: US 11,143,977 B2
(45) Date of Patent: Oct. 12, 2021

(54) LABELS

(71) Applicant: HP Indigo B.V., Amstelveen (NL)

(72) Inventors: Asaf Salant, Nes Ziona (IL); Dani Tulchinski, Nes Ziona (IL); Inna Tzomik, Nes Ziona (IL); Daniel Skvirsky, Nes Ziona (IL); Tony Azzam, Nes Ziona (IL)

(73) Assignee: HP Indigo B.V., Amstelveen (NL)

( * ) Notice: Subject to any disclaimer, the term of this patent is extended or adjusted under 35 U.S.C. 154(b) by 188 days.

(21) Appl. No.: 16/095,025

(22) PCT Filed: Jul. 21, 2016

(86) PCT No.: PCT/EP2016/067430
§ 371 (c)(1),
(2) Date: Oct. 19, 2018

(87) PCT Pub. No.: WO2018/014961
PCT Pub. Date: Jan. 25, 2018

(65) Prior Publication Data

US 2019/0146376 A1 May 16, 2019

(51) Int. Cl.
*G03G 13/10* (2006.01)
*G03G 8/00* (2006.01)
(Continued)

(52) U.S. Cl.
CPC ..... *G03G 13/10* (2013.01); *G03G 7/008* (2013.01); *G03G 7/0026* (2013.01);
(Continued)

(58) Field of Classification Search
CPC ..... G03G 13/10; G03G 13/20; G03G 8/00
See application file for complete search history.

(56) References Cited

U.S. PATENT DOCUMENTS 6,761,940 B2 7/2004 Kammerer et al.
6,797,746 B2 9/2004 Cavazos-Gutierrez
(Continued)

FOREIGN PATENT DOCUMENTS

CN 101533222 9/2009
CN 104080705 10/2014
(Continued)

OTHER PUBLICATIONS

International Search Report dated Apr. 4, 2017 for PCT/EP2016/067430, Applicant Hewlett-Packard Indigo B.V.

*Primary Examiner* — Christopher D Rodee
(74) *Attorney, Agent, or Firm* — Thorpe North & Western LLP

(57) ABSTRACT

Herein is described a method of producing a printed label. The method may comprise: a. providing a label substrate having a first surface and a second surface, wherein the first and second surfaces form opposing surfaces of the label substrate; b. applying a primer comprising a cross-linkable primer resin onto the first surface of a label substrate to form a primer layer; c. electrophotographically printing onto the primer layer an electrostatic ink composition comprising a cross-linkable thermoplastic resin to form a printed layer; d. applying a cross-linking composition comprising a cross-linking agent to the printed layer, wherein the cross-linking agent penetrates into the electrostatic ink composition and the primer layer; and e. activating the cross-linking agent wherein an adhesive is present on the second surface of the label substrate in step a or applied to the second surface of the label substrate at any point in the method after step a. Printed labels are also described herein.

12 Claims, 1 Drawing Sheet

(51) Int. Cl.
*G03G 7/00* (2006.01)
*G03G 13/20* (2006.01)

(52) U.S. Cl.
CPC ..... *G03G 7/0086* (2013.01); *G03G 8/00* (2013.01); *G03G 13/20* (2013.01)

(56) References Cited

U.S. PATENT DOCUMENTS

| | | | | |
|---|---|---|---|---|
| 8,440,749 | B2 | 5/2013 | Kagaya et al. | |
| 8,936,841 | B2 | 1/2015 | Katarya et al. | |
| 2003/0049423 | A1* | 3/2003 | Kammerer | B65D 65/42 428/204 |
| 2006/0177636 | A1* | 8/2006 | Reich | G09F 3/10 428/195.1 |
| 2007/0243293 | A1* | 10/2007 | Janssen | B32B 27/32 426/124 |
| 2013/0101809 | A1 | 4/2013 | Kohlweyer et al. | |
| 2016/0109817 | A1* | 4/2016 | Ron | G03G 9/13 430/117.1 |
| 2016/0121622 | A1 | 5/2016 | Mor et al. | |
| 2019/0018333 | A1* | 1/2019 | Tzomik | G03G 9/135 |

FOREIGN PATENT DOCUMENTS

| | | | |
|---|---|---|---|
| EP | 1291716 | 3/2003 | |
| EP | 1341048 | 9/2003 | |
| EP | 2042564 | 4/2009 | |
| EP | 2730403 | 5/2014 | |
| IN | 214751 | 1/2006 | |
| WO | 2014187497 | 11/2014 | |
| WO | WO-2016128046 A1 * | 8/2016 | G03G 9/133 |
| WO | 2017067610 | 4/2017 | |
| WO | 2017162305 | 9/2017 | |
| WO | 2018014961 | 1/2018 | |
| WO | 2018014962 | 1/2018 | |

* cited by examiner

LABELS

BACKGROUND

Printed labels are used on or in many types of product to display information, differentiate products and comply with regulatory requirements, such as ingredients lists, safety warnings, etc.

DETAILED DESCRIPTION

Figure 1:
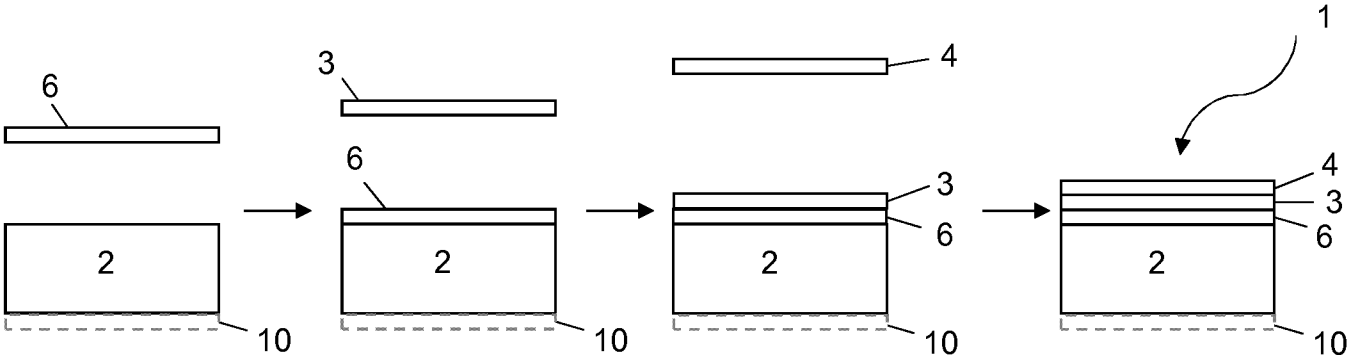
FIG. 1 shows schematically an example of a method for producing a printed label.

Before the present disclosure is disclosed and described, it is to be understood that this disclosure is not restricted to the particular process features and materials disclosed herein because such process features and materials may vary somewhat. It is also to be understood that the terminology used herein is used for the purpose of describing particular examples.

It is noted that, as used in this specification and the appended claims, the singular forms "a", "an", and "the" include plural referents unless the context clearly dictates otherwise.

As used herein, "carrier fluid", "carrier liquid", or "carrier vehicle" refers to the fluid in which pigment particles, colorant, charge directors and other additives can be dispersed to form a liquid electrostatic composition or electrophotographic composition. The carrier liquids may include a mixture of a variety of different agents, such as surfactants, co-solvents, viscosity modifiers, and/or other possible ingredients.

As used herein, "electrostatic ink composition" or "liquid electrophotographic composition" generally refers to an ink composition that is generally suitable for use in an electrostatic printing process, sometimes termed an electrophotographic printing process. It may comprise pigment particles, which may comprise a thermoplastic resin.

As used herein, "pigment" generally includes pigment colorants, magnetic particles, aluminas, silicas, and/or other ceramics or organometallics, whether or not such particulates impart color. Thus, though the present description primarily exemplifies the use of pigment colorants, the term "pigment" can be used more generally to describe not just pigment colorants, but other pigments such as organometallics, ferrites, ceramics, etc.

As used herein, "co-polymer" refers to a polymer that is polymerized from at least two monomers.

As used herein, "melt flow rate" generally refers to the extrusion rate of a resin through an orifice of defined dimensions at a specified temperature and load, usually reported as temperature/load, e.g., 190° C./2.16 kg. Flow rates can be used to differentiate grades or provide a measure of degradation of a material as a result of molding. In the present disclosure, "melt flow rate" is measured per ASTM D1238-04c Standard Test Method for Melt Flow Rates of Thermoplastics by Extrusion Plastometer. If a melt flow rate of a particular polymer is specified, unless otherwise stated, it is the melt flow rate for that polymer alone, in the absence of any of the other components of the electrostatic composition.

As used herein, "acidity", "acid number", or "acid value" refers to the mass of potassium hydroxide (KOH) in milligrams that neutralizes one gram of a substance. The acidity of a polymer can be measured according to standard techniques, for example, as described in ASTM D1386. If the acidity of a particular polymer is specified, unless otherwise stated, it is the acidity for that polymer alone, in the absence of any of the other components of the liquid toner composition.

As used herein, "melt viscosity" generally refers to the ratio of shear stress to shear rate at a given shear stress or shear rate. Testing is generally performed using a capillary rheometer. A plastic charge is heated in the rheometer barrel and is forced through a die with a plunger. The plunger is pushed either by a constant force or at constant rate depending on the equipment. Measurements are taken once the system has reached steady-state operation. One method used is measuring Brookfield viscosity@140° C., units are mPa·s or cPoise. In some examples, the melt viscosity can be measured using a rheometer, e.g., a commercially available AR-2000 Rheometer from Thermal Analysis Instruments, using the geometry of 25 mm steel plate—standard steel parallel plate, and finding the plate over plate rheometry isotherm at 120° C., 0.01 Hz shear rate. If the melt viscosity of a particular polymer is specified, unless otherwise stated, it is the melt viscosity for that polymer alone, in the absence of any of the other components of the electrostatic ink composition.

A certain monomer may be described herein as constituting a certain weight percentage of a polymer. This indicates that the repeating units formed from the said monomer in the polymer constitute said weight percentage of the polymer.

If a standard test is mentioned herein, unless otherwise stated, the version of the test to be referred to is the most recent at the time of filing this patent application.

As used herein, "electrostatic printing" or "electrophotographic printing" generally refers to the process that provides an image that is transferred from a photo imaging substrate either directly or indirectly via an intermediate transfer member to a substrate, for example a label substrate. As such, the image is not substantially absorbed into the photo imaging substrate on which it is applied. Additionally, "electrophotographic printers" or "electrostatic printers" generally refer to those printers capable of performing electrophotographic printing or electrostatic printing, as described above. "Liquid electrophotographic printing" is a specific type of electrophotographic printing where a liquid composition is employed in the electrophotographic process rather than a powder toner. An electrostatic printing process may involve subjecting the electrostatic composition to an electric field, for example, an electric field having a field gradient of 50-400 V/μm, or more, in some examples 600-900V/μm, or more.

As used herein, "substituted" may indicate that a hydrogen atom of a compound or moiety is replaced by another atom such as a carbon atom or a heteroatom, which is part of a group referred to as a substituent. Substituents include, for example, alkyl, alkoxy, aryl, aryloxy, alkenyl, alkenoxy, alkynyl, alkynoxy, thioalkyl, thioalkenyl, thioalkynyl, thioaryl, etc.

As used herein, "heteroatom" may refer to nitrogen, oxygen, halogens, phosphorus, or sulfur.

As used herein, "alkyl", or similar expressions such as "alk" in alkoxy, may refer to a branched, unbranched, or cyclic saturated hydrocarbon group, which may, in some examples, contain from 1 to about 50 carbon atoms, or 1 to about 40 carbon atoms, or 1 to about 30 carbon atoms, or 1 to about 10 carbon atoms, or 1 to about 5 carbon atoms.

The term "aryl" may refer to a group containing a single aromatic ring or multiple aromatic rings that are fused together, directly linked, or indirectly linked (such that the different aromatic rings are bound to a common group such as a methylene or ethylene moiety). Aryl groups described herein may contain, but are not limited to, from 5 to about 50 carbon atoms, or 5 to about 40 carbon atoms, or 5 to about 30 carbon atoms or more, and may be selected from, phenyl and naphthyl.

As used herein, the term "about" is used to provide flexibility to a numerical range endpoint by providing that a given value may be a little above or a little below the endpoint to allow for variation in test methods or apparatus. The degree of flexibility of this term can be dictated by the particular variable as would be understood in the art.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not just the numerical values explicitly recited as the end points of the range, but also to include all the individual numerical values or sub-ranges encompassed within that range as if each numerical value and sub-range is explicitly recited. As an illustration, a numerical range of "about 1 wt % to about 5 wt %" should be interpreted to include not just the explicitly recited values of about 1 wt % to about 5 wt %, but also to include individual values and subranges within the indicated range. Thus, included in this numerical range are individual values such as 2, 3.5, and 4 and sub-ranges such as from 1-3, from 2-4, and from 3-5, etc. This same principle applies to ranges reciting a single numerical value. Furthermore, such an interpretation should apply regardless of the breadth of the range or the characteristics being described.

As used herein, wt % values are to be taken as referring to a weight-for-weight (w/w) percentage of solids in the ink composition, and not including the weight of any carrier fluid present.

Unless otherwise stated, any feature described herein can be combined with any aspect or any other feature described herein.

In an aspect, there is provided a method of producing a printed label. The method may comprise:

a. providing a label substrate having a first surface and a second surface, wherein the first and second surfaces form opposing surfaces of the label substrate;
b. applying a primer comprising a cross-linkable primer resin onto the first surface of a label substrate to form a primer layer;
c. electrophotographically printing onto the primer layer an electrostatic ink composition comprising a cross-linkable thermoplastic resin to form a printed layer;
d. applying a cross-linking composition comprising a cross-linking agent to the printed layer, wherein the cross-linking agent penetrates into the electrostatic ink composition and the primer layer; and
e. activating the cross-linking agent wherein an adhesive is present on the second surface of the label substrate in step a or applied to the second surface of the label substrate at any point in the method after step a.

In another aspect, there is provided a printed label. The printed label may comprise:

a label substrate having opposing first and second surfaces;
a primer layer disposed on the first surface of the label substrate, wherein the primer comprises a primer resin;
a printed layer disposed on the primer layer, wherein the printed layer comprises an electrostatic ink composition comprising a thermoplastic resin; and
an adhesive layer disposed on the second surface of the label substrate;
wherein a cross-linking agent has been applied to the printed layer and allowed to penetrate into the electrostatic ink composition and the primer layer, and the cross-linking agent has been activated to cross-link the thermoplastic resin of the electrostatic ink composition and the primer resin of the primer layer.

In light of the importance of much of the information provided on labels to both consumers and regulatory bodies, it is desirable that printed labels are sufficiently durable that this information remains visible under the conditions that the product is packaged (for example, during sterilization and/or bottling), stored (whether, for example, in a refrigerated environment or hot and/or humid shelving), transported, displayed and used. The present inventors have investigated using electrostatic printing techniques to print labels. However, the present inventors have found that many existing electrostatic inks are vulnerable to the chemical and water environments to which they may be subjected during their lifecycle. Indeed, even the use of one or two different over print varnishes to protect electrostatically printed inks from their environment may not provide sufficient durability to the inks. The present inventors have found that examples of the methods and products described herein avoid or at least mitigate at least one of these difficulties. They have found that examples of the method and products have increased durability under chemical and water environments, providing increased scratch and rub resistance to the printed labels.

Printed Label

In some examples, a printed label is described. The printed label may be produced by any of the methods described herein. Each component of the printed label will be discussed in the sections which follow.

Label Substrate

The label substrate may be any label substrate suitable for use in a label. The label substrate may be any suitable substrate capable of having an image printed thereon. The label substrate may comprise opposing first and second surfaces. In some examples, the second surface of the label substrate is suitable for application of an adhesive. In some examples, an adhesive layer is present on the second surface of the label substrate.

The label substrate may comprise opposing first and second surfaces. In some examples, an adhesive layer is disposed on the second surface of the label substrate. In some examples, the second surface of the label substrate is suitable for the application of an adhesive layer. In some examples, an adhesive layer is disposed on the second surface of the label substrate. In some examples, in the method, an adhesive is present on the second surface of the label substrate in step a or applied to the second surface of the label substrate at any point in the method after step a. A removable release layer may be present on the adhesive layer, e.g. to protect the adhesive layer during storage, which can be removed prior to use of the label.

The first surface of the label substrate may be the surface onto which a primer is applied to form a primer layer. The first surface of the label substrate may be or comprise any material that is suitable for the application of a primer layer.

The label substrate may include a material selected from an organic or inorganic material. The label substrate may include a natural polymeric material, for example, cellulose. The label substrate may include a synthetic polymeric material, for example, a polymer formed from alkylene monomers, including, for example, polyethylene and polypropylene, and co-polymers, such as styrene-polybutadiene. In some examples, the polypropylene may be biaxially oriented polypropylene.

In some examples, the label substrate may be or comprise a cellulosic substrate, such as a cellulosic paper. In some examples, the cellulosic substrate may be or comprise an uncoated cellulosic substrate, that is, absent of a coating of a polymeric material. In some examples, the cellulosic substrate may be a coated cellulosic substrate. In some examples, the cellulosic substrate, which may be a cellulosic paper, is coated with a polymeric material, for example, a polymer formed from styrene-butadiene resin. In some examples, the cellulosic paper has an inorganic material bound to its surface (before the primer layer is applied) with a polymeric material, wherein the inorganic material may be selected from, for example, kaolinite or calcium carbonate.

The label substrate may be or comprise an acrylic substrate, in some examples, a coated acrylic substrate, for example, coated with a styrene-butadiene co-polymer.

In some examples, the label substrate may be a transparent label substrate and the adhesive layer, once it has been adhered to a second substrate, may also be transparent.

In some examples, the label substrate may comprise a polymeric material. In some examples, the polymeric material may comprise a transparent polymeric material. In some examples, the label substrate comprises a film, for example, a thin film, of a polymeric material. In some examples, the polymeric material may comprise a polymer formed from alkylene monomers, including, for example, polyethylene and polypropylene, and co-polymers such as styrene-polybutadiene. In some examples, the polymeric material may comprise polyethylene (PE), linear low density polyethylene (LLDPE), low density polyethylene (LDPE), medium density polyethylene (MDPE), high density polyethylene (HDPE), polypropylene (PP), cast (cPP) or biaxially oriented polypropylene (BOPP), oriented polyamide (OPA) or polyethylene terephthalate (PET).

In some examples, the label substrate may be or comprise a metal, which may be in sheet form. In some examples, the label substrate may comprise a metallic foil or a metallized substrate. In some examples, the label substrate may comprise a metallized paper (i.e. paper having a metal layer thereon) or a metallized plastic film (i.e. plastic film having a metal layer thereon). In some examples, the metal may be selected from or made from, for example, aluminium (Al), silver (Ag), tin (Sn), copper (Cu), or mixtures thereof. In some examples, the label substrate may comprise an aluminium foil.

In some examples, the label substrate may comprise a plurality of layers of material, in some examples, a plurality of layers of film material laminated together. In some examples, the label substrate may comprise a plurality of layers of material selected from polymeric materials (e.g., polymeric materials selected from PE, LLDPE, MDPE, PP, BOPP, PET and OPA), metallic materials (e.g., metallic foils such as aluminium foil, or metallized films such as metallized-PET (met-PET), or metallized-BOPP (met-BOPP), or metallized paper such as met-paper or any other metalized substrate), paper and combinations thereof. In some examples, the label substrate comprises a plurality of layers of film of a polymeric material, such as a combination of films selected from PE, LLDPE, MDPE, PP, BOPP, PET and OPA, laminated together to form a pre-laminated label substrate. In some examples, the pre-laminated label substrate may comprise a metallic layer, such as an aluminium layer. In some examples, the pre-laminated label substrate may comprise a Paper/Alu/PE, PET/Al/PE, BOPP/met-BOPP or PET/PE laminate.

In some examples, the label substrate may comprise a metallized paper in the form of a paper substrate coated on at least one surface with a layer of metal, for example, aluminium.

In some examples, the label substrate may comprise a metallized polymeric film in the form of a polymer substrate coated on at least one surface with a layer of metal, for example, aluminium. In some examples, the label substrate comprises a metallized polymeric film in the form of a metallized BOPP film or a metallized PET film.

In some examples, the label substrate may comprise a thin film of material, wherein the film is 600 μm or less in thickness, for example, 250 μm or less in thickness, for example, 200 μm or less in thickness, for example, 150 μm or less in thickness, for example, 100 μm or less in thickness, for example, 90 μm or less in thickness, for example, 80 μm or less in thickness, 70 μm or less in thickness, 60 μm or less in thickness, 50 μm or less in thickness, 40 μm or less in thickness, 30 μm or less in thickness, 20 μm or less in thickness, 15 μm or less in thickness. In some examples, the film of material is about 12 μm in thickness.

In some examples, the label substrate may comprise a thin film of material, wherein the film is 12 μm or more in thickness, for example, 15 μm or more in thickness, 20 μm or more in thickness, 30 μm or more in thickness, 40 μm or more in thickness, 50 μm or more in thickness, 60 μm or more in thickness, 70 μm or more in thickness, 80 μm or more in thickness, 90 μm or more in thickness. In some examples, the film of material is about 100 μm or more in thickness, in some examples, about 100 μm in thickness.

Adhesive Layer

In some examples, the adhesive layer is disposed on the second surface of the label substrate. In some examples, a removable release layer may be present on the adhesive layer, which can be removed prior to use of the label.

In some examples, the adhesive layer is applied to the second surface of the label substrate before the label substrate is provided for the method of producing a printed label. In some examples, the adhesive is applied to the second surface of the label substrate before, during or after the application of the primer to the first surface of the label substrate. In some examples, the adhesive is applied to the second surface of the label substrate before, during or after the electrophotographic printing of the electrostatic ink composition onto the primer layer. In some examples, the adhesive is applied to the second surface of the label substrate before, during or after application of the cross-linking composition to the printed layer. In some examples, the adhesive is applied to the second surface of the label substrate before, during or after activation of the cross-linking agent.

In some examples, the removable release layer is applied at the same time as the adhesive layer is applied. In some examples, the removable release layer is applied immediately after the adhesive layer is applied. In some examples, the removable release layer is applied after the adhesive layer is applied but prior to the next layer being applied to the first surface of the label substrate.

In some examples, the adhesive layer is a pressure-sensitive adhesive layer, a heat-sensitive adhesive layer, a contact adhesive layer, a drying adhesive layer (that is, an adhesive that adheres on drying), a radiation-curing adhesive layer (e.g., a UV-curing adhesive layer) or a moisture-curing adhesive layer (e.g., an adhesive that cures by reacting with moisture present, for example, on a second substrate to which the label is, in use, applied or adhered, or in the air). The pressure sensitive adhesive may be a hot melt pressure sensitive adhesive, such as for example a rubber-based or acrylic-based pressure sensitive adhesive. The adhesive could be based on a rubber-based hot melt composition, a solvent rubber adhesive, a solvent acrylic adhesive, or a solvent polyurethane adhesive. The adhesive could be emulsion-based such as an emulsion acrylic adhesive.

In some examples, the adhesive layer is 100 μm or less in thickness, for example, 90 μm or less in thickness, 80 μm or less in thickness, 70 μm or less in thickness, 60 μm or less in thickness, 50 μm or less in thickness, 40 μm or less in thickness, 30 μm or less in thickness, 20 μm or less in thickness, or 15 μm or less in thickness. In some examples, the adhesive layer is about 12 μm in thickness.

In some examples, the adhesive layer is 12 μm or more in thickness, for example, 15 μm or more in thickness, 20 μm or more in thickness, 30 μm or more in thickness, 40 μm or more in thickness, 50 μm or more in thickness, 60 μm or more in thickness, 70 μm or more in thickness, 80 μm or more in thickness, 90 μm or more in thickness. In some examples, the adhesive layer is 100 μm or more in thickness, in some examples, about 100 μm in thickness.

Primer

The method of producing a printed label may comprise applying a primer onto a first surface of the label substrate to form a primer layer. The printed label may comprise a primer layer disposed on the first surface of the label substrate.

The primer comprises a primer resin. The primer resin in the method of producing a printed label may comprise a cross-linkable primer resin. The primer resin in the printed label may comprise a cross-linked primer resin.

In a printed label, the primer resin may be a cross-linked primer resin. In the method of producing a printed label, the primer resin may be a cross-linkable primer resin until the cross-linking agent is activated, when the primer resin may become a cross-linked primer resin.

In some examples, the primer resin may be selected from the group comprising or consisting of hydroxyl containing resins, carboxylic group containing resins, amine based polymer formulations, and combinations thereof. In some examples, a hydroxyl containing resin may be selected from polyvinyl alcohol resins, for example, polyvinyl alcohol based polyvinyl butyral formulations (such as Butvar resins from Eastman), Vinnol® (from Wacker polymers), cellulose derivative additives (from Eastman), polyester resins (such as Dynapol from Evonic) and polyurethane-based formulations with hydroxyl groups. In some examples, the carboxylic group containing resins may be selected from olefin co-acrylic or methacrylic acid based copolymers, polyacrylic acid based polymers, and polylactic acid based polymers. In some examples, the amine based polymer formulations may be selected from polyamines and polyethylene imines. The primer resin may be selected from the group comprising, or consisting of, a polyvinyl alcohol resin, cellulose based resins, a polyester, a polyamine, a polyethylene imine resin, polyamide resin, polyurethane, copolymers of an alkylene monomer and an acrylic or methacrylic acid monomer, and polyacrylic polymers.

In some examples, the primer resin comprises a carboxylic functional group, an amine functional group or a polyol functional group, or a combination thereof. In some examples, the primer resin comprises an amine functional group or a carboxylic functional group.

In some examples, the primer resin comprises an amine functional group. In some examples, the primer resin comprises or consists of a polyethylene imine resin.

An example of a material suitable as a primer is Michelman DigiPrime® 050.

In some examples, the primer layer on the label substrate of the printed label comprises a cross-linked primer resin.

In some examples, the primer on the surface of the label substrate is applied or has been applied in an amount such that the coat weight of the primer resin on the label substrate is 0.01 $g/m^2$ or more, in some examples, 0.05 $g/m^2$ or more, in some examples, 0.1 $g/m^2$ or more, in some examples, in some examples, 0.14 $g/m^2$ or more, 0.15 $g/m^2$ or more, in some examples, about 0.18 $g/m^2$. In some examples, the primer is provided in an amount such that the coat weight of the primer resin on the label substrate is up to about 0.2 $g/m^2$, in some examples, up to about 0.5 $g/m^2$, in some examples, up to about 1 $g/m^2$, in some examples, up to about 1.5 $g/m^2$.

Printed Layer

Electrostatic Ink Composition

Electrostatic printing, for example, liquid electrostatic printing, is one method by which images or information can be printed onto substrates such as label substrates. The electrostatic printing process generally involves creating an image on a photoconductive surface, applying a liquid electrostatic ink or a dry toner having charged particles to the photoconductive surface, such that they selectively bind to the image, and then transferring the charged particles in the form of the image to a substrate, such as a label substrate.

The electrostatic ink composition may be electrophotographically printed onto the primer layer. The electrostatic ink composition may comprise a thermoplastic resin. The electrostatic ink composition in the method of producing a printed label may comprise a cross-linkable thermoplastic resin. The electrostatic ink composition in the printed label may comprise a cross-linked thermoplastic resin.

In a printed label, the thermoplastic resin may be a cross-linked thermoplastic resin. In the method of producing a printed label, the thermoplastic resin may be a cross-linkable thermoplastic resin until the cross-linking agent is activated, when the thermoplastic resin may become a cross-linked thermoplastic resin.

In some examples, the electrostatic ink composition may be a liquid electrostatic ink composition or a powder toner, that is, a dry toner for use in dry electrostatic printing.

The electrostatic ink composition printed on the primer layer described herein may be a liquid electrostatic ink composition (also referred to herein as a liquid electrophotographic printing composition, an LEP composition, a liquid electrostatic printing composition or an LEP ink composition), printed on the primer layer using an electrophotographic printing process, for example, a liquid electrophotographic (LEP) printing process. In some examples, the electrostatic ink composition may comprise a colorant or pigment and a thermoplastic resin. In some examples, the electrostatic ink composition may be a liquid electrostatic ink composition, which may comprise a colorant or pigment, a thermoplastic resin and a carrier fluid or liquid. The liquid electrostatic ink composition may further comprise an additive such as a charge director, charge adjuvant, surfactant, viscosity modifier, emulsifier and the like. In some examples, the colorant is a pigment. In some examples, the liquid electrostatic ink composition may not contain any pigment, or may comprise substantially zero pigment and thus be a pigment-free composition, which may be useful in providing a particular transparent gloss or sheen to a label substrate.

In some examples, after printing, an LEP ink composition, which may be printed on the primer layer, may comprise a reduced amount of carrier liquid compared with the LEP ink composition before printing. In some examples, an LEP ink composition, once printed on the primer layer, may be substantially free from carrier liquid. Substantially free from carrier liquid may indicate that the ink printed on the primer layer contains less than 5 wt. % carrier liquid, in some examples, less than 2 wt. % carrier liquid, in some examples, less than 1 wt. % carrier liquid, in some examples, less than 0.5 wt. % carrier liquid. In some examples, an electrostatic ink composition that may be printed on the primer layer is free from carrier liquid.

Each of these components of an electrostatic ink composition, which may be the ink composition printed on the primer layer, will be described separately in the sub-sections which follow.

Thermoplastic Resin

The thermoplastic resin may be referred to as a polymer resin or a thermoplastic polymer. In some examples, the thermoplastic resin of the electrostatic ink composition comprises a carboxylic functional group, an amine functional group, a polyol functional group or a combination thereof. In some examples, the thermoplastic resin of the electrostatic ink composition comprises a carboxylic functional group. In some examples, the thermoplastic resin of the electrostatic ink composition comprises an amine functional group. In some examples, the thermoplastic resin of the electrostatic ink composition comprises a polyol functional group.

In some examples, the thermoplastic resin comprises or consists of a polymer having acidic side groups. In some examples, the acidic side groups may be in free acid form or may be in the form of an anion and associated with a courterion, generally metal counterions, for example, a metal selected from the alkali metals, such as lithium, sodium and potassium, alkali earth metals, such as magnesium or calcium, and transition metals, such as zinc. In some examples, the thermoplastic resin may comprise a copolymer of an alkylene monomer and a monomer selected from acrylic acid and methacrylic acid. The thermoplastic resin having acidic side groups can be selected from resins such as co-polymers of ethylene and an ethylenically unsaturated acid of either acrylic acid or methacrylic acid; and ionomers thereof, such as methacrylic acid and ethylene-acrylic or methacrylic acid co-polymers which are at least partially neutralized with metal ions (e.g., Zn, Na, Li) such as SURLYN® ionomers. The thermoplastic resin comprising acidic side groups can be a co-polymer of ethylene and an ethylenically unsaturated acid of either acrylic or methacrylic acid, where the ethylenically unsaturated acid of either acrylic or methacrylic acid may constitute from 5 wt. % to about 25 wt. % of the co-polymer, in some examples, from 10 wt. % to about 20 wt. % of the co-polymer.

In some examples, the thermoplastic resin of the electrostatic ink composition comprises polyolefin co-polymers, polyethylene co-acrylic co-polymers, polyethylene co-methacrylic co-polymers, polyethylene co-vinyl acetate co-polymers, ionomers, or combinations thereof. In some examples, the thermoplastic resin of the electrostatic ink composition comprises or consists of alkylene acrylic or methacrylic acid resins, polyurethane resins, polyethylene imine resins, polyamide resins, polyvinyl alcohol resins, and combinations thereof.

In some examples, the thermoplastic resin may comprise ethylene or propylene acrylic acid co-polymers; ethylene or propylene methacrylic acid co-polymers; ethylene vinyl acetate co-polymers; co-polymers of ethylene or propylene (e.g., 80 wt. % to 99.9 wt. %), and alkyl (e.g., C1 to C5) ester of methacrylic or acrylic acid (e.g., 0.1 wt. % to 20 wt. %); co-polymers of ethylene (e.g., 80 wt. % to 99.9 wt. %), acrylic or methacrylic acid (e.g., 0.1 wt. % to 20.0 wt. %) and alkyl (e.g., C1 to C5) ester of methacrylic or acrylic acid (e.g., 0.1 wt. % to 20 wt. %); co-polymers of ethylene or propylene (e.g., 70 wt. % to 99.9 wt. %) and maleic anhydride (e.g., 0.1 wt. % to 30 wt. %); polyethylene; polystyrene; isotactic polypropylene (crystalline); co-polymers of ethylene ethyl acrylate; polyesters; polyvinyl toluene; polyamides; styrene/butadiene co-polymers; epoxy resins; acrylic resins (e.g., co-polymer of acrylic or methacrylic acid and at least one alkyl ester of acrylic or methacrylic acid wherein alkyl may have from 1 to about 20 carbon atoms, such as methyl methacrylate (e.g., 50 wt. % to 90 wt. %)/methacrylic acid (e.g., 0 wt. % to 20 wt. %)/ethylhexylacrylate (e.g., 10 wt. % to 50 wt. %); ethylene-acrylate terpolymers: ethylene-acrylic esters-maleic anhydride (MAH) or glycidyl methacrylate (GMA) terpolymers; ethylene-acrylic acid ionomers or combinations thereof.

The thermoplastic resin may comprise a polymer having acidic side groups. The polymer having acidic side groups may have an acidity of 50 mg KOH/g or more, in some examples, an acidity of 60 mg KOH/g or more, in some examples, an acidity of 70 mg KOH/g or more, in some examples, an acidity of 80 mg KOH/g or more, in some examples, an acidity of 90 mg KOH/g or more, in some examples, an acidity of 100 mg KOH/g or more, in some examples, an acidity of 105 mg KOH/g or more, in some examples, 110 mg KOH/g or more, in some examples, 115 mg KOH/g or more. The polymer having acidic side groups may have an acidity of 200 mg KOH/g or less, in some examples, 190 mg or less, in some examples, 180 mg or less, in some examples, 130 mg KOH/g or less, in some examples, 120 mg KOH/g or less. The acidity of a polymer in mg KOH/g can be measured by using standard procedures, for example, by using the procedure described in ASTM D1386.

The thermoplastic resin may comprise a polymer having acidic side groups that has a melt flow rate of about 70 g/10 minutes or less, in some examples, about 60 g/10 minutes or less, in some examples, about 50 g/10 minutes or less, in some examples, about 40 g/10 minutes or less, in some examples, 30 g/10 minutes or less, in some examples, 20 g/10 minutes or less, in some examples, 10 g/10 minutes or less. In some examples, all polymers having acidic side groups and/or ester groups in the particles each individually have a melt flow rate of 90 g/10 minutes or less, in some examples, 80 g/10 minutes or less, in some examples, 70 g/10 minutes or less, in some examples, 60 g/10 minutes or less.

The polymer having acidic side groups can have a melt flow rate of about 10 g/10 minutes to about 120 g/10 minutes, in some examples, about 10 g/10 minutes to about 70 g/10 minutes, in some examples, about 10 g/10 minutes to about 40 g/10 minutes, in some examples, about 20 g/10 minutes to about 30 g/10 minutes. The polymer having acidic side groups can have a melt flow rate of, in some examples, about 50 g/10 minutes to about 120 g/10 minutes, in some examples, about 60 g/10 minutes to about 100 g/10 minutes. The melt flow rate can be measured using standard procedures, for example, as described in ASTM D1238.

The acidic side groups may be in free acid form or may be in the form of an anion and associated with a counterion, generally metal counterions, for example, a metal selected from the alkali metals, such as lithium, sodium and potassium, alkali earth metals, such as magnesium or calcium, and transition metals, such as zinc. The thermoplastic resin having acidic sides groups can be selected from resins such as co-polymers of ethylene and an ethylenically unsaturated acid of either acrylic acid or methacrylic acid; and ionomers thereof, such as methacrylic acid and ethylene-acrylic or methacrylic acid co-polymers that are at least partially neutralized with metal ions (e.g., Zn, Na, Li) such as SURLYN® ionomers. The polymer comprising acidic side groups can be a co-polymer of ethylene and an ethylenically unsaturated acid of either acrylic or methacrylic acid, in which the ethylenically unsaturated acid of either acrylic or methacrylic acid constitutes from 5 wt. % to about 25 wt. % of the co-polymer, in some examples, from 10 wt. % to about 20 wt. % of the co-polymer.

The thermoplastic resin may comprise two different polymers having acidic side groups. The two polymers having acidic side groups may have different acidities, which may fall within the ranges mentioned above. The thermoplastic resin may comprise a first polymer having acidic side groups that has an acidity of from 10 mg KOH/g to 110 mg KOH/g, in some examples, 20 mg KOH/g to 110 mg KOH/g, in some examples, 30 mg KOH/g to 110 mg KOH/g, in some examples, 50 mg KOH/g to 110 mg KOH/g, and a second polymer having acidic side groups that has an acidity of 110 mg KOH/g to 130 mg KOH/g.

The thermoplastic resin may comprise two different polymers having acidic side groups: a first polymer having acidic side groups that has a melt flow rate of about 10 g/10 minutes to about 50 g/10 minutes and an acidity of from 10 mg KOH/g to 110 mg KOH/g, in some examples, 20 mg KOH/g to 110 mg KOH/g, in some examples, 30 mg KOH/g to 110 mg KOH/g, in some examples, 50 mg KOH/g to 110 mg KOH/g, and a second polymer having acidic side groups that has a melt flow rate of about 50 g/10 minutes to about 120 g/10 minutes and an acidity of 110 mg KOH/g to 130 mg KOH/g. The first and second polymers may be absent of ester groups.

In some examples, the ratio of the first polymer having acidic side groups to the second polymer having acidic side groups can be from about 10:1 to about 2:1. In some examples, the ratio can be from about 6:1 to about 3:1, in some examples, about 4:1.

The thermoplastic resin may comprise a polymer having a melt viscosity of 15000 poise or less, in some examples, a melt viscosity of 10000 poise or less, in some examples, 1000 poise or less, in some examples, 100 poise or less, in some examples, 50 poise or less, in some examples, 10 poise or less; said polymer may be a polymer having acidic side groups as described herein. The thermoplastic resin may comprise a first polymer having a melt viscosity of 15000 poise or more, in some examples, 20000 poise or more, in some examples, 50000 poise or more, in some examples, 70000 poise or more; and in some examples, the polymer resin may comprise a second polymer having a melt viscosity less than the first polymer, in some examples, a melt viscosity of 15000 poise or less, in some examples, a melt viscosity of 10000 poise or less, in some examples, 1000 poise or less, in some examples, 100 poise or less, in some examples, 50 poise or less, and in some examples, 10 poise or less. The thermoplastic resin may comprise a first polymer having a melt viscosity of more than 60000 poise, in some examples, from 60000 poise to 100000 poise, in some examples, from 65000 poise to 85000 poise; a second polymer having a melt viscosity of from 15000 poise to 40000 poise, in some examples, 20000 poise to 30000 poise, and a third polymer having a melt viscosity of 15000 poise or less, in some examples, a melt viscosity of 10000 poise or less, in some examples, 1000 poise or less, in some examples, 100 poise or less, in some examples, 50 poise or less, in some examples, 10 poise or less; an example of the first polymer is Nucrel 960 (from DuPont), an example of the second polymer is Nucrel 699 (from DuPont), and an example of the third polymer is AC-5120 or AC-5180 (from Honeywell). The first, second and third polymers may be polymers having acidic side groups as described herein. The melt viscosity can be measured by using a rheometer, for example, a commercially available AR-2000 Rheometer from Thermal Analysis Instruments, by using the geometry of 25 mm steel plate—standard steel parallel plate, and finding the plate over plate rheometry isotherm at 120° C., 0.01 Hz shear rate.

If the thermoplastic resin comprises a single type of polymer, the polymer (excluding any other components of the electrostatic ink composition) may have a melt viscosity of 6000 poise or more, in some examples, a melt viscosity of 8000 poise or more, in some examples, a melt viscosity of 10000 poise or more, in some examples, a melt viscosity of 12000 poise or more. If the thermoplastic resin comprises a plurality of polymers all of the polymers of the thermoplastic resin may together form a mixture (excluding any other components of the electrostatic ink composition) that has a melt viscosity of 6000 poise or more, in some examples, a melt viscosity of 8000 poise or more, in some examples, a melt viscosity of 10000 poise or more, in some examples, a melt viscosity of 12000 poise or more. Melt viscosity can be measured by using standard techniques. The melt viscosity can be measured by using a rheometer, for example, a commercially available AR-2000 Rheometer from Thermal Analysis Instruments, by using the geometry of 25 mm steel plate—standard steel parallel plate, and finding the plate over plate rheometry isotherm at 120° C., 0.01 Hz shear rate.

The thermoplastic resin may comprise two different polymers having acidic side groups that are selected from co-polymers of ethylene and an ethylenically unsaturated acid of either acrylic acid or methacrylic acid; or ionomers thereof, such as methacrylic acid and ethylene-acrylic or methacrylic acid co-polymers which are at least partially neutralized with metal ions (e.g., Zn, Na, Li) such as SURLYN® ionomers. The thermoplastic resin may comprise (i) a first polymer that is a co-polymer of ethylene and an ethylenically unsaturated acid of either acrylic acid or methacrylic acid, wherein the ethylenically unsaturated acid of either acrylic or methacrylic acid constitutes from 8 wt. % to about 16 wt. % of the co-polymer, in some examples, 10 wt. % to 16 wt. % of the co-polymer; and (ii) a second polymer that is a co-polymer of ethylene and an ethylenically unsaturated acid of either acrylic acid or methacrylic acid, wherein the ethylenically unsaturated acid of either acrylic or methacrylic acid constitutes from 12 wt. % to about 30 wt. % of the co-polymer, in some examples, from 14 wt. % to about 20 wt. % of the co-polymer, in some examples, from 16 wt. % to about 20 wt. % of the co-polymer, and in some examples, from 17 wt. % to 19 wt. % of the co-polymer.

The thermoplastic resin may comprise a polymer having acidic side groups, as described above (which may be free of ester side groups), and a polymer having ester side groups. The polymer having ester side groups may be a thermoplastic polymer. The polymer having ester side groups may further comprise acidic side groups. The polymer having ester side groups may be a co-polymer of a monomer having ester side groups and a monomer having acidic side groups. The polymer may be a co-polymer of a monomer having ester side groups, a monomer having acidic side groups, and a monomer absent of any acidic and ester side groups. The monomer having ester side groups may be a monomer selected from esterified acrylic acid or esterified methacrylic acid. The monomer having acidic side groups may be a monomer selected from acrylic or methacrylic acid. The monomer absent of any acidic and ester side groups may be an alkylene monomer, including, for example, ethylene or propylene. The esterified acrylic acid or esterified methacrylic acid maybe an alkyl ester of acrylic acid or an alkyl ester of methacrylic acid, respectively. The alkyl group in the alkyl ester of acrylic or methacrylic acid may be an alkyl group having 1 to 30 carbon atoms, in some examples, 1 to 20 carbon atoms, in some examples, 1 to 10 carbon atoms; in some examples, selected from methyl, ethyl, iso-propyl, n-propyl, t-butyl, iso-butyl, n-butyl and pentyl.

The polymer having ester side groups may be a co-polymer of a first monomer having ester side groups, a second monomer having acidic side groups and a third monomer which is an alkylene monomer absent of any acidic and ester side groups. The polymer having ester side groups may be a co-polymer of (i) a first monomer having ester side groups selected from esterified acrylic acid or esterified methacrylic acid, in some examples an alkyl ester of acrylic or methacrylic acid, (ii) a second monomer having acidic side groups selected from acrylic or methacrylic acid, and (iii) a third monomer which is an alkylene monomer selected from ethylene and propylene. The first monomer may constitute 1% to 50% by weight of the co-polymer, in some examples, 5% to 40% by weight, in some examples, 5% to 20% by weight of the co-polymer, and in some examples, 5% to 15% by weight of the co-polymer. The second monomer may constitute 1% to 50% by weight of the co-polymer, in some examples, 5% to 40% by weight of the co-polymer, in some examples, 5% to 20% by weight of the co-polymer, and in some examples, 5% to 15% by weight of the co-polymer. In some examples, the first monomer constitutes 5% to 40% by weight of the co-polymer, the second monomer constitutes 5% to 40% by weight of the co-polymer, with the third monomer constituting the remaining weight of the co-polymer. In some examples, the first monomer constitutes 5% to 15% by weight of the co-polymer, the second monomer constitutes 5% to 15% by weight of the co-polymer, with the third monomer constituting the remaining weight of the co-polymer. In some examples, the first monomer constitutes 8% to 12% by weight of the co-polymer, the second monomer constitutes 8% to 12% by weight of the co-polymer, with the third monomer constituting the remaining weight of the co-polymer. In some examples, the first monomer constitutes about 10% by weight of the co-polymer, the second monomer constitutes about 10% by weight of the co-polymer, with the third monomer constituting the remaining weight of the co-polymer. The polymer may be selected from the Bynel® class of polymers, including Bynel 2022 and Bynel 2002, which are available from DuPont®.

The polymer having ester side groups may constitute 1% or more by weight of the total amount of the resin polymers, for example, thermoplastic resins, in the liquid electrostatic ink composition and/or the electrostatic ink printed on the primer layer, for example, the total amount of the polymer or polymers having acidic side groups and polymer having ester side groups. The polymer having ester side groups may constitute 5% or more by weight of the total amount of the resin polymers, that is, the thermoplastic resin polymers, in some examples, 8% or more by weight of the total amount of the resin polymers, for example, thermoplastic resin polymers, in some examples, 10% or more by weight of the total amount of the resin polymers, for example, thermoplastic resin polymers, in some examples, 15% or more by weight of the total amount of the resin polymers, for example, thermoplastic resin polymers, in some examples, 20% or more by weight of the total amount of the resin polymers, for example, thermoplastic resin polymers, in some examples, 25% or more by weight of the total amount of the resin polymers, for example, thermoplastic resin polymers, in some examples, 30% or more by weight of the total amount of the resin polymers, for example, thermoplastic resin polymers, in some examples, 35% or more by weight of the total amount of the resin polymers, for example, thermoplastic resin polymers, in the liquid electrostatic ink composition and/or the electrostatic ink printed on the primer layer. The polymer having ester side groups may constitute from 5% to 50% by weight of the total amount of the resin polymers, for example, thermoplastic resin polymers, in the liquid electrostatic composition and/or the ink printed on the primer layer, in some examples, 10% to 40% by weight of the total amount of the resin polymers, for example, thermoplastic resin polymers, in the liquid electrostatic ink composition and/or the electrostatic ink composition printed on the primer layer, in some examples, 5% to 30% by weight of the total amount of the resin polymers, for example, thermoplastic resin polymers, in the liquid electrostatic ink composition and/or the ink composition printed on the primer layer, in some examples, 5% to 15% by weight of the total amount of the resin polymers, for example, thermoplastic resin polymers, in the liquid electrostatic ink composition and/or the ink composition printed on the primer layer, in some examples, 15% to 30% by weight of the total amount of the resin polymers, for example, thermoplastic resin polymers, in the liquid electrostatic ink composition and/or the ink composition printed on the primer layer.

The polymer having ester side groups may have an acidity of 50 mg KOH/g or more, in some examples, an acidity of 60 mg KOH/g or more, in some examples, an acidity of 70 mg KOH/g or more, in some examples, an acidity of 80 mg KOH/g or more. The polymer having ester side groups may have an acidity of 100 mg KOH/g or less, in some examples, 90 mg KOH/g or less. The polymer having ester side groups may have an acidity of 60 mg KOH/g to 90 mg KOH/g, in some examples, 70 mg KOH/g to 80 mg KOH/g.

The polymer having ester side groups may have a melt flow rate of about 10 g/10 minutes to about 120 g/10 minutes, in some examples, about 10 g/10 minutes to about 50 g/10 minutes, in some examples, about 20 g/10 minutes to about 40 g/10 minutes, in some examples, about 25 g/10 minutes to about 35 g/10 minutes.

The polymer, polymers, co-polymer, or co-polymers of the thermoplastic resin can in some examples be selected from the Nucrel family of resins (e.g., Nucrel 403™, Nucrel 407™ Nucrel 609HS™, Nucrel 908HS™, Nucrel 1202HC™, Nucrel 30707™, Nucrel 1214™, Nucrel 903™, Nucrel 3990™, Nucrel 910™, Nucrel 925™, Nucrel 699™, Nucrel 599™, Nucrel 960™, Nucrel RX76™, Nucrel 2806™, Bynell 2002, Bynell 2014, Bynell 2020 and Bynell 2022 (sold by E. I. du PONT)), the AC family of resins (e.g., AC-5120, AC-5180, AC-540, AC-580 (sold by Honeywell)), the Aclyn family of resins (e.g., Aclyn 201, Aclyn 246, Aclyn 285, Aclyn 295 (sold by Honeywell)), and the Lotader family of resins (e.g., Lotader 2210, Lotader, 3430, and Lotader 8200 (sold by Arkema)).

The polymer resin can constitute about 5 to 90%, in some examples, about 50 to 80%, by weight of the solids of the liquid electrostatic ink composition and/or the ink composition printed on the label substrate. The resin can constitute about 60 to 95%, in some examples, about 70 to 95%, by weight of the solids of the liquid electrostatic ink composition and/or the ink composition printed on the primer layer.

Colorant

An electrostatic ink composition may comprise a colorant. The colorant may be a dye or a pigment. The colorant can be any colorant compatible with the liquid carrier and useful for electrophotographic printing. For example, the colorant may be present as pigment particles or may comprise a resin (in addition to the resins described herein) and a pigment. The resins and pigments can be any of those standardly used. In some examples, the colorant is selected from a cyan pigment, a magenta pigment, a yellow pigment and a black pigment. For example, pigments by Hoechst including Permanent Yellow DHG, Permanent Yellow GR, Permanent Yellow G, Permanent Yellow NCG-71, Permanent Yellow GG, Hansa Yellow RA, Hansa Brilliant Yellow 5GX-02, Hansa Yellow X, NOVAPERM® YELLOW HR, NOVAPERM® YELLOW FGL, Hansa Brilliant Yellow 10GX, Permanent Yellow G3R-01, HOSTAPERM® YELLOW H4G, HOSTAPERM® YELLOW H3G, HOSTAPERM® ORANGE GR, HOSTAPERM® SCARLET GO, Permanent Rubine F6B; pigments by Sun Chemical including L74-1357 Yellow, L75-1331 Yellow, L75-2337 Yellow; pigments by Heubach including DALAMAR® YELLOW YT-858-D; pigments by Ciba-Geigy including CROMOPHTHAL® YELLOW 3 G, CROMOPHTHAL® YELLOW GR, CROMOPHTHAL® YELLOW 8 G, IRGAZINE® YELLOW 5GT, IRGALITE® RUBINE 4BL, MONASTRAL® MAGENTA, MONASTRAL® SCARLET, MONASTRAL® VIOLET, MONASTRAL® RED, MONASTRAL® VIOLET; pigments by BASF including LUMOGEN® LIGHT YELLOW, PALIOGEN® ORANGE, HELIOGEN® BLUE L 690 IF, HELIOGEN® BLUE TBD 7010, HELIOGEN® BLUE K 7090, HELIOGEN® BLUE L 710 IF, HELIOGEN® BLUE L 6470, HELIOGEN® GREEN K 8683, HELIOGEN® GREEN L 9140; pigments by Mobay including QUINDO® MAGENTA, INDOFAST® BRILLIANT SCARLET, QUINDO® RED 6700, QUINDO® RED 6713, INDOFAST® VIOLET; pigments by Cabot including Maroon B STERLING® NS BLACK, STERLING® NSX 76, MOGUL® L; pigments by DuPont including TIPURE® R-101; and pigments by Paul Uhlich including UHLICH® BK 8200. In some examples, the pigment may be a white pigment. Where the pigment is a white pigment particle, the pigment particle may be selected from the group consisting of $TiO_2$, calcium carbonate, zinc oxide, and mixtures thereof. In some examples, the white pigment particle may comprise an alumina-$TiO_2$ pigment.

In some examples, the colorant or pigment particles may have a median particle size or $d_{50}$ of 20 μm or less, for example, 15 μm or less, for example, 10 μm or less, for example, 5 μm or less, for example, 4 μm or less, for example, 3 μm or less, for example, 2 μm or less, for example, 1 μm or less, for example, 0.9 μm or less, for example, 0.8 μm or less, for example, 0.7 μm or less, for example, 0.6 μm or less, for example, 0.5 μm or less. Unless otherwise stated, the particle size of the colorant or pigment particle and the resin coated pigment particle is determined by using laser diffraction on a Malvern Mastersizer 2000 according to the standard procedure as described in the operating manual.

The colorant or pigment particle may be present in an electrostatic ink composition in an amount of from 10 wt. % to 80 wt. % of the total amount of resin and pigment, in some examples, 15 wt. % to 80 wt. %, in some examples, 15 wt. % to 60 wt. %, in some examples, 15 wt. % to 50 wt. %, in some examples, 15 wt. % to 40 wt. %, in some examples, 15 wt. % to 30 wt. % of the total amount of resin and colorant. In some examples, the colorant or pigment particle may be present in an electrostatic ink composition in an amount of at least 50 wt. % of the total amount of resin and colorant or pigment, for example, at least 55 wt. % of the total amount of resin and colorant or pigment.

Carrier Liquid

In some examples, an electrostatic ink composition described herein comprises thermoplastic resin coated pigment particles, or thermoplastic resin particles, which are formed in and/or dispersed in a carrier fluid or carrier liquid. Before application to the primer layer in an electrostatic printing process, the electrostatic ink composition, may be in dry form, for example, in the form of flowable pigment particles coated with the thermoplastic resin. In some examples, before application to the primer layer in an electrostatic printing process, an electrostatic ink composition may be in liquid form, and may comprise a carrier liquid in which is suspended pigment particles, which may be coated with the thermoplastic resin.

Generally, the carrier liquid acts as a reaction solvent in preparing the coated pigment particles, and can also act as a dispersing medium for the other components in the resulting electrostatic ink composition. In some examples, the carrier liquid is a liquid which does not dissolve the thermoplastic resin at room temperature. In some examples, the carrier liquid is a liquid which dissolves the thermoplastic resin at elevated temperatures. For example, the thermoplastic resin may be soluble in the carrier liquid when heated to a temperature of at least 80° C., for example, at least 90° C., for example, at least 100° C., for example, at least 110° C., for example, at least 120° C. For example, the carrier liquid may comprise or be a hydrocarbon, silicone oil, vegetable oil, and the like. The carrier liquid may include an insulating, non-polar, non-aqueous liquid that can be used as a medium for toner particles. The carrier liquid may include compounds that have a resistivity in excess of about $10^9$ ohm·cm. The carrier liquid may have a dielectric constant of about 5 or less, in some examples, about 3 or less. The carrier liquid may include hydrocarbons. The hydrocarbon may be an aliphatic hydrocarbon, an isomerized aliphatic hydrocarbon, a branched chain aliphatic hydrocarbon, an aromatic hydrocarbon, and combinations thereof. Examples of the carrier liquids include aliphatic hydrocarbons, isoparaffinic compounds, paraffinic compounds, dearomatized hydrocarbon compounds, and the like. In particular, the carrier liquid may include Isopar-G™, Isopar-H™, Isopar-L™, Isopar-M™, Isopar-K™, Isopar-V™, Norpar 12™, Norpar 13™, Norpar 15™, Exxol D40™, Exxol D80™, Exxol D100™, Exxol D130™, and Exxol D140™ (each sold by EXXON CORPORATION); Teclen N-16™, Teclen N-20™, Teclen N-22™, Nisseki Naphthesol L™, Nisseki Naphthesol M™, Nisseki Naphthesol H™, #0 Solvent L™, #0 Solvent M™, #0 Solvent H™, Nisseki Isosol 300™ Nisseki Isosol 400™, AF-4™, AF-5™, AF-6™ and AF-7™ (each sold by NIPPON OIL CORPORATION); IP Solvent 1620™ and IP Solvent 2028™ (each sold by IDEMITSU PETROCHEMICAL CO., LTD.); Amsco OMS™ and Amsco 460™ (each sold by AMERICAN MINERAL SPIRITS CORP.); and Electron, Positron, New II, Purogen HF (100% synthetic terpenes) (sold by ECOLINK™).

Before printing, the carrier liquid may constitute about 20% to 99.5% by weight of an electrostatic ink composition, in some examples, 50% to 99.5% by weight of an electrostatic ink composition. Before printing, the carrier liquid may constitute about 40 to 90% by weight of an electrostatic ink composition. Before printing, the carrier liquid may constitute about 60% to 80% by weight of an electrostatic ink composition. Before printing, the carrier liquid may constitute about 90% to 99.5% by weight of an electrostatic ink composition, in some examples, 95% to 99% by weight of an electrostatic ink composition.

An electrostatic ink composition, when printed on a label substrate may be substantially free from carrier liquid. In an electrostatic printing process and/or afterwards, the carrier liquid may be removed, for example, by an electrophoresis processes during printing and/or evaporation, such that substantially just solids are transferred to the primer layer. Substantially free from carrier liquid may indicate that the ink printed on the primer layer contains 5 wt. % or less carrier liquid, in some examples, 2 wt. % or less carrier liquid, in some examples, 1 wt. % or less carrier liquid, in some examples, 0.5 wt. % or less carrier liquid. In some examples, the ink printed on the primer layer is free from carrier liquid.

Charge Director and Charge Adjuvant

A liquid electrostatic ink composition and/or the ink composition printed on the primer layer may comprise a charge director. A charge director can be added to an electrostatic ink composition to impart a charge of a desired polarity and/or maintain sufficient electrostatic charge on the particles of an electrostatic ink composition. The charge director may comprise ionic compounds, including, for example, metal salts of fatty acids, metal salts of sulfosuccinates, metal salts of oxyphosphates, metal salts of alkyl-benzenesulfonic acid, metal salts of aromatic carboxylic acids or sulfonic acids, as well as zwitterionic and non-ionic compounds, such as polyoxyethylated alkylamines, lecithin, polyvinylpyrrolidone, organic acid esters of polyvalent alcohols, and the like. The charge director may be selected from oil-soluble petroleum sulfonates (e.g., neutral Calcium Petronate™, neutral Barium Petronate™, and basic Barium Petronate™), polybutylene succinimides (e.g., OLOA™ 1200 and Amoco 575), and glyceride salts (e.g., sodium salts of phosphated mono- and diglycerides with unsaturated and saturated acid substituents), sulfonic acid salts including, for example, barium, sodium, calcium, and aluminium salts of sulfonic acid. The sulfonic acids may include, for example, alkyl sulfonic acids, aryl sulfonic acids, and sulfonic acids of alkyl succinates (e.g., see WO 2007/130069). The charge director may impart a negative charge or a positive charge on the resin-containing particles of an electrostatic ink composition.

The charge director can comprise a sulfosuccinate moiety of the general formula: $[R_a—O—C(O)CH_2CH(SO_3^-)C(O)—O—R_b]$, in which each of $R_a$ and $R_b$ is an alkyl group. In some examples, the charge director comprises nanoparticles of a simple salt and a sulfosuccinate salt of the general formula $MA_n$, wherein M is a metal, n is the valence of M, and A is an ion of the general formula $[R_a—O—C(O)CH_2CH(SO_3^-)C(O)—O—R_b]$, in which each of $R_a$ and $R_b$ is an alkyl group, or other charge directors as found in WO 2007130069, which is incorporated herein by reference in its entirety. As described in WO 2007130069, the sulfosuccinate salt of the general formula $MA_n$ is an example of a micelle forming salt. The charge director may be substantially free of or free of an acid of the general formula HA, in which A is as described above. The charge director may comprise micelles of said sulfosuccinate salt enclosing at least some of the nanoparticles. The charge director may comprise at least some nanoparticles having a size of 200 nm or less, in some examples, 2 nm or more. As described in WO 2007130069, simple salts are salts that do not form micelles by themselves, although they may form a core for micelles with a micelle forming salt. The ions constructing the simple salts are all hydrophilic. The simple salt may comprise a cation selected from Mg, Ca, Ba, $NH_4$, tert-butyl ammonium, $Li^+$, and $Al^{3+}$, or from any sub-group thereof. The simple salt may comprise an anion selected from $SO_4^{2-}$, $PO^{3-}$, $NO_3^-$, $HPO_4^{2-}$, $CO_3^{2-}$, acetate, trifluoroacetate (TFA), $Cl^-$, $Br^-$, $BF_4^-$, $F^-$, $ClO_4^-$, and $TiO_3^{4-}$, or from any sub-group thereof. The simple salt may be selected from $CaCO_3$, $Ba_2TiO_3$, $Al_2(SO_4)$, $Al(NO_3)_3$, $Ca_3(PO_4)_2$, $BaSO_4$, $BaHPO_4$, $Ba_2(PO_4)_3$, $CaSO_4$, $(NH_4)_2CO_3$, $(NH_4)_2SO_4$, $NH_4OAc$, tert-butyl ammonium bromide, $NH_4NO_3$, LiTFA, $Al_2(SO_4)_3$, $LiClO_4$, and $LiBF_4$, or any sub-group thereof. The charge director may further comprise basic barium petronate (BBP).

In the formula $[R_a—O—C(O)CH_2CH(SO_3^-)C(O)—O—R_b]$, in some examples, each of $R_a$ and $R_b$ is an aliphatic alkyl group. In some examples, each of $R_a$ and $R_b$ independently is a $C_{6-25}$ alkyl group. In some examples, said aliphatic alkyl group is linear. In some examples, said aliphatic alkyl group is branched. In some examples, said aliphatic alkyl group includes a linear chain of 6 carbon atoms or more. In some examples, $R_a$ and $R_b$ are the same. In some examples, at least one of $R_a$ and $R_b$ is $C_{13}H_{27}$. In some examples, M is Na, K, Cs, Ca, or Ba. The formula $[R_a—O—C(O)CH_2CH(SO_3^-)C(O)—O—R_b]$ and/or the formula $MA_n$ may be as defined in any part of WO 2007130069.

The charge director may comprise (i) soya lecithin, (ii) a barium sulfonate salt, such as basic barium petronate (BPP), and (iii) an isopropyl amine sulfonate salt. Basic barium petronate is a barium sulfonate salt of a 21-26 carbon atom hydrocarbon alkyl chain, and can be obtained, for example, from Chemtura. An example isopropyl amine sulphonate salt is dodecyl benzene sulfonic acid isopropyl amine, which is available from Croda.

In an electrostatic ink composition, the charge director can constitute about 0.001% to 20% by weight, in some examples, 0.01 to 20% by weight, in some examples, 0.01 to 10% by weight, in some examples, 0.01 to 1% by weight of the solids of an electrostatic ink composition and/or ink composition printed on the primer layer. The charge director can constitute about 0.001 to 0.15% by weight of the solids of a liquid electrophotographic ink composition and/or ink composition printed on the primer layer, in some examples, 0.001 to 0.15% by weight, in some examples, 0.001 to 0.02% by weight of the solids of a liquid electrophotographic ink composition and/or ink composition printed on the primer layer. In some examples, a charge director imparts a negative charge on an electrostatic ink composition. The particle conductivity may range from 50 to 500 pmho/cm, in some examples, from 200-350 pmho/cm.

A liquid electrophotographic ink composition and/or ink composition printed on the primer layer may include a charge adjuvant. A charge adjuvant may be present with a charge director, and may be different to the charge director, and act to increase and/or stabilise the charge on particles, for example, resin-containing particles, of an electrostatic ink composition. The charge adjuvant may include barium petronate, calcium petronate, Co salts of naphthenic acid, Ca salts of naphthenic acid, Cu salts of naphthenic acid, Mn salts of naphthenic acid, Ni salts of naphthenic acid, Zn salts of naphthenic acid, Fe salts of naphthenic acid, Ba salts of stearic acid, Co salts of stearic acid, Pb salts of stearic acid, Zn salts of stearic acid, Al salts of stearic acid, Cu salts of stearic acid, Fe salts of stearic acid, metal carboxylates (e.g., Al tristearate, Al octanoate, Li heptanoate, Fe stearate, Fe distearate, Ba stearate, Cr stearate, Mg octanoate, Ca stearate, Fe naphthenate, Zn naphthenate, Mn heptanoate, Zn heptanoate, Ba octanoate, Al octanoate, Co octanoate, Mn octanoate, and Zn octanoate), Co lineolates, Mn lineolates, Pb lineolates, Zn lineolates, Ca oleates, Co oleates, Zn palmirate, Ca resinates, Co resinates, Mn resinates, Pb resinates, Zn resinates, AB diblock co-polymers of 2-ethylhexyl methacrylate-co-methacrylic acid calcium, and ammonium salts, co-polymers of an alkyl acrylamidoglycolate alkyl ether (e.g., methyl acrylamidoglycolate methyl ether-co-vinyl acetate), and hydroxy bis(3,5-di-tert-butyl salicylic) aluminate monohydrate. In some examples, the charge adjuvant is aluminium di- and/or tristearate and/or aluminium di- and/or tripalmitate.

The charge adjuvant may constitute about 0.1 to 5% by weight of the solids of a liquid electrostatic ink composition and/or ink composition printed on the primer layer. The charge adjuvant may constitute about 0.5 to 4% by weight of the solids of a liquid electrostatic ink composition and/or ink composition printed on the primer layer. The charge adjuvant may constitute about 1 to 3% by weight of the solids of a liquid electrostatic ink composition and/or ink composition printed on the primer layer.

Other Additives

In some examples, an electrostatic ink composition may include an additive or a plurality of additives. The additive or plurality of additives may be added at any stage of the production of the electrostatic ink composition. The additive or plurality of additives may be selected from a wax, a surfactant, biocides, organic solvents, viscosity modifiers, materials for pH adjustment, sequestering agents, preservatives, compatibility additives, emulsifiers and the like. The wax may be an incompatible wax. As used herein, "incompatible wax" may refer to a wax that is incompatible with the resin. Specifically, the wax phase separates from the resin phase upon cooling of the resin fused mixture on a primer layer during and after the transfer of the ink film to the primer layer, for example, from an intermediate transfer member, which may be a heated blanket.

Cross-Linking Composition

The cross-linking composition may comprise a cross-linking agent, for example, for cross-linking the thermoplastic resin of the electrostatic ink composition and for cross-linking the primer resin of the primer. Applying the cross-linking composition comprising a cross-linking agent onto the printed layer disposed on the primer layer disposed on a first surface of the label substrate may result in the cross-linking agent penetrating into the electrostatic ink composition of the printed layer and into the primer layer. Applying the cross-linking composition comprising a cross-linking agent onto the printed layer disposed on the primer layer disposed on a first surface of the label substrate may result in the cross-linking agent penetrating into the electrostatic ink composition of the printed layer, into the primer layer and into the label substrate. The cross-linking agent penetrating into a layer may allow the two adjacent layers to cross-link to each other when the cross-linking agent is activated. The cross-linking agent penetrating into a layer may mean that at least some of the cross-linking agent is present in the layer and does not imply that the cross-linking agent flows through and out of the other side of the layer. The cross-linking agent penetrating into a layer may mean that the cross-linking agent is present throughout the layer.

Cross-linking the thermoplastic resin of the electrostatic ink composition may increase cohesion in the printed layer disposed on the primer layer, which is disposed on a first surface of the label substrate. Cross-linking the thermoplastic resin of the electrostatic ink composition may increase the melting temperature of the electrostatic ink composition. Cross-linking the thermoplastic resin of the electrostatic ink composition may increase the chemical and water resistance of the electrostatic ink composition, in some examples, by reducing swelling and dissolution. Cross-linking the primer resin of the primer may increase cohesion within the primer. Cross-linking the primer resin of the primer may increase the chemical and water resistance of the primer, in some examples, by reducing swelling and dissolution. Cross-linking the primer resin may also limit mobility of the ink composition disposed on the primer layer. Cross-linking between the primer resin and the thermoplastic resin may improve binding between the primer and the electrostatic ink composition, reduce the mobility of the electrostatic ink composition and/or the primer, and/or increase the melting temperature of the electrostatic ink composition. Cross-linking of the primer resin of the primer, cross-linking of the thermoplastic resin of the electrostatic ink composition and/or cross-linking of the primer resin of the primer to the thermoplastic resin of the electrostatic ink composition may improve the mechanical durability and chemical and water resistance of the printed label. Cross-linking of the primer resin of the primer, cross-linking of the thermoplastic resin of the electrostatic ink composition and/or cross-linking of the primer resin of the primer to the thermoplastic resin of the electrostatic ink composition may improve the durability of the printed layer in the presence of and after subjection to chemicals and water.

The cross-linking agent may be any cross-linking agent suitable to cross-link the thermoplastic resin of the electrostatic ink composition. The cross-linking agent may be any cross-linking agent suitable to cross-link the thermoplastic resin of the electrostatic ink composition and to cross-link the primer resin of the primer. The cross-linking agent may be any cross-linking agent suitable to cross-link the thermoplastic resin of the electrostatic ink composition, to cross-link the primer resin of the primer and to cross-link the thermoplastic resin of the electrostatic ink composition to the primer resin of the primer.

In some examples, the cross-linking agent may, once activated, cross-link the thermoplastic resin within the electrostatic ink composition.

In some examples, the cross-linking agent may, once activated, cross-link the thermoplastic resin within the electrostatic ink composition and cross-link the thermoplastic resin of the electrostatic ink composition with the primer resin of the primer.

In some examples, the cross-linking agent may, once activated, cross-link the thermoplastic resin within the electrostatic ink composition, cross-link the primer resin within the primer and cross-link the thermoplastic resin of the electrostatic ink composition with the primer resin of the primer.

In some examples, the cross-linking agent may, once activated, cross-link the thermoplastic resin within the electrostatic ink composition, cross-link the primer resin within the primer, cross-link the thermoplastic resin of the electrostatic ink composition with the primer resin of the primer and cross-link the primer resin with the label substrate.

In some examples, the cross-linking composition comprises a cross-linking agent in an amount of about 0.01 wt. % or more by total weight of the cross-linking composition, in some examples, about 0.1 wt. % or more, in some examples, about 0.5 wt. % or more, in some examples, about 1 wt. % or more, in some examples, about 1.5 wt. % or more, in some examples, about 2 wt. % or more, in some examples, about 2.5 wt. % or more, in some examples, about 3 wt. % or more, in some examples, about 4 wt. % or more, in some examples, about 5 wt. % or more, in some examples, about 8 wt. % or more, in some examples 10 wt. % or more, in some examples 15 wt % or more, in some examples 20 wt % or more.

In some examples, the cross-linking composition comprises a cross-linking agent in an amount up to about 30 wt. % by total weight of the cross-linking composition, in some examples, up to about 25 wt. %, in some examples, up to about 20 wt. %, in some examples, up to about 15 wt. %, in some examples, up to about 10 wt. %. The remaining wt. % of the cross-linking composition may be a carrier solvent as described below.

In some examples, the cross-linking composition comprises a cross-linking agent in an amount within the range of about 0.5 wt. % to about 30 wt. % by total weight of the cross-linking composition, in some examples an amount within the range of about 0.5 wt. % to about 20 wt. % by total weight of the cross-linking composition, in some examples an amount within the range of about 0.5 wt. % to about 20 wt. % by total weight of the cross-linking composition.

In some examples, the cross-linking composition comprises a carrier solvent in which the cross-linker may be dissolved or dispersed. In some examples, the carrier solvent is selected from water, ethyl acetate, ethanol, methyl ethyl ketone, acetone, isopropanol and combinations thereof.

In some examples, the cross-linking composition comprises a carrier solvent present in an amount of about 70 wt. % or more by total weight of the cross-linking composition, in some examples, about 75 wt. % or more, in some examples, about 80 wt. % or more, in some examples, about 85 wt. % or more, in some examples, about 90 wt. % or more, in some examples, about 95 wt. %.

In some examples, the cross-linking composition comprises a carrier solvent present in an amount up to about 99.99 wt. %, in some examples, up to about 99.95 wt. %, in some examples, up to about 99.5 wt. %, in some examples, up to about 99 wt. %, in some examples, up to about 98.5 wt. %, in some examples, up to about 98 wt. %, in some examples, up to about 97 wt. %, in some examples, up to about 96 wt. %, in some examples, up to about 95 wt. %, in some examples, up to about 90 wt. %, in some examples, up to about 85 wt. %, in some examples, up to about 80 wt. %, in some examples, up to about 75 wt. %, in some examples, up to about 70 wt. %.

In some examples, the cross-linking composition comprises a carrier solvent present in an amount in the range of about 70 wt. % to about 99.99 wt. %, .%, in some examples 75 wt. % to about 99.99 wt. %, in some examples 80 wt. % to about 99.99 wt. %.

In some examples, the cross-linking composition comprises, consists essentially of or consists of a cross-linking agent and a carrier solvent.

In some examples, the cross-linking composition comprises, consists essentially of or consists of:

- a cross-linking agent in an amount within the range of about 0.5 wt. % to about 30 wt. % by total weight of the cross-linking composition; and
- a carrier solvent in an amount within the range of about 70 wt. % to about 99.5 wt. %.

In some examples, the cross-linking composition comprises, consists essentially of or consists of:

- a cross-linking agent in an amount within the range of about 0.5 wt. % to about 25 wt. % by total weight of the cross-linking composition; and
- a carrier solvent in an amount within the range of about 75 wt. % to about 99.5 wt. %.

In some examples, the cross-linking composition comprises, consists essentially of or consists of:

- a cross-linking agent in an amount within the range of about 0.5 wt. % to about 20 wt. % by total weight of the cross-linking composition; and
- a carrier solvent in an amount within the range of about 80 wt. % to about 99.5 wt. %.

In some examples, the cross-linking composition comprises, consists essentially of or consists of:

- a cross-linking agent in an amount within the range of about 0.5 wt. % to about 15 wt. % by total weight of the cross-linking composition; and
- a carrier solvent in an amount within the range of about 85 wt. % to about 99.5 wt. %.

In some examples, the cross-linking composition comprises, consists essentially of or consists of:

- a cross-linking agent in an amount within the range of about 0.5 wt. % to about 10 wt. % by total weight of the cross-linking composition; and
- a carrier solvent in an amount within the range of about 90 wt. % to about 99.5 wt. %.

In some examples, the cross-linking composition may comprise a photo-initiator. In some examples, the cross-linking composition comprises, consists essentially of or consists of a cross-linking agent, a carrier solvent and a photo-initiator.

As used herein, the phrase "consist essentially of" may mean that 95 wt. % or more, in some examples, 99 wt. % or more, of the composition consists of a cross-linking agent and a carrier solvent.

In some examples, the cross-linking composition has a viscosity of 2000 mPa·s or less, for example, 1500 mPa·s or less, for example, 1000 mPa·s or less, for example, 500 mPa·s or less, for example, 250 mPa·s or less, for example, 100 mPa·s or less, for example, 50 mPa·s or less. The viscosity of the cross-linking composition is measured at 25° C. Viscosity given in mPa·s is the dynamic viscosity, and may be measured using a viscometer.

Cross-Linking Agent

In some examples, the cross-linking composition comprises a cross-linking agent that is reactive towards a carboxylic functional group, an amine functional group, a polyol functional group, or a combination thereof.

In some examples, the cross-linking composition comprises a cross-linking agent that is reactive towards a carboxylic functional group and/or an amine functional group.

For example, when the thermoplastic resin and/or the primer resin comprise a carboxylic functional group the cross-linking agent may comprise an epoxide, an aziridine, an organic metallic complex or ion, an organosilane, an epoxy organosilane, a carbodiimide, an isocyanate or an acetyl acetonate.

For example, when the thermoplastic resin and/or the primer resin comprise an amine functional group, the cross-linking agent may comprise an epoxide, an aziridine, an isocyanate, a maleic anhydride, an isocyanate alkyl organosilane, an epoxy organosilane, a carbodiimide, an aldehyde, a ketone, an acetyl acetonate, an isothiocyanate, an acyl azide, an N-hydroxysuccinimide ester (NHS ester), a sulfonyl chloride glyoxal, a carbonate, an aryl halide or an imidoester.

In some examples, when the thermoplastic resin comprises a polymer having acid side groups and the primer resin comprises an amine functional group (e.g., polyethylene imine), the cross-linking agent may be selected from an epoxy-based cross-linking agent, an aziridine-based cross-linking agent, an isocyanate-based cross-linking agent or a carbodiimide-based cross-linking agent. In some examples, when the thermoplastic resin comprises a polymer having acid side groups and the primer resin comprises an amine functional group (e.g., polyethylene imine), the cross-linking agent may be an epoxy-based cross-linking agent.

In some examples, the cross-linking composition comprises a cross-linking agent selected from an epoxide, an aziridine, an isocyanate, a maleic anhydride, an organic metallic complex or ion, an organosilane, an epoxy organosilane, a carbodiimide, an aldehyde, a ketone, an acetyl acetonate or combinations thereof.

In some examples, the cross-linking composition comprises a cross-linking agent selected from an epoxide, an aziridine, and a carbodiimide. For example, the cross-linking composition may comprise an epoxide, an aziridine, or a carbodiimide.

In some examples, the cross-linking composition comprises an epoxide as the cross-linking agent.

The cross-linking agent may comprise a group selected from epoxy, aziridine, isocyanate, maleic anhydride, anhydride, organosilane, epoxy organosilane, carbodiimide, aldehyde, ketone, acetyl acetonate, organic metallic complexes or ions, or a combination thereof.

In some examples, the cross-linking agent may be an epoxy-based cross-linking agent, aziridine-based cross-linking agent, isocyanate-based cross-linking agent, maleic anhydride-based cross-linking agent, anhydride-based cross-linking agent, organosilane-based cross-linking agent, epoxy organosilane-based cross-linking agent, carbodiimide-based cross-linking agent, aldehyde-based cross-linking agent, ketone-based cross-linking agent, or acetyl acetonate-based cross-linking agent as described below.

In some examples, the cross-linking agent has a molecular weight of more than 5000 Daltons. In some examples, the cross-linking agent has a molecular weight of 5000 Daltons or less, in some examples, 4000 Daltons or less, in some examples, 3000 Daltons or less, in some examples, 1500 Daltons or less, in some examples, a molecular weight of 1000 Daltons or less, in some examples, a molecular weight of 700 Daltons or less, in some examples, a molecular weight of 600 Daltons or less. In some examples, the cross-linking agent has a molecular weight of from 100 to 1500 Daltons, in some examples, a molecular weight of from 100 to 600 Daltons.

In some examples, the cross-linking agent comprises a group selected from epoxy, aziridine, isocyanate or carbodiimide.

In some examples, the cross-linking agent comprises a polyepoxide, a polyaziridine, a polyisocyanate or a polycarbodiimide.

In some examples, the cross-linking agent is an epoxy-based cross-linking agent, for example, a polyepoxide. The term 'polyepoxide' is used herein to refer to a molecule comprising at least two epoxy groups, for example, of the formula —CH(O)CR$^1$H, wherein R$^1$ is selected from H and alkyl, in some examples, wherein R$^1$ is H.

In some examples, the epoxy-based cross-linking agent is of the formula (I):

$$(X)—(Y—[Z—F]_m)_n$$

wherein, in each (Y—[Z—F]$_m$), Y, Z and F are each independently selected, such that F is an epoxy group, for example, of the formula —CH(O)CR$^1$H, wherein R$^1$ is selected from H and alkyl;

Z is alkylene,

Y is selected from (i) a single bond, —O—, —C(═O)—O—, —O—C(═O)— wherein m is 1 or (ii) Y is $NH_{2-m}$ wherein m is 1 or 2, n is at least 1, in some examples at least 2, in some examples 2-4, and X is an organic group.

In some examples, the cross-linking agent of formula (I) has at least two F groups.

In some examples, F is an epoxide of the formula —CH(O)CR$^1$H in which R$^1$ is H.

X may comprise or be an organic group selected from optionally substituted alkylene, optionally substituted alkyl, optionally substituted aryl, optionally substituted arylalkyl, optionally substituted alkylaryl, isocyanurate, and polysiloxane. X may comprise a polymeric component; in some examples, the polymeric components may be selected from a polysilane, polysiloxane (such as poly(dimethyl siloxane), a polyalkylene (such as polyethylene or polypropylene), an acrylate (such as methyl acrylate) and a poly(alkylene glycol) (such as poly(ethylene glycol) and poly(propylene glycol)), and combinations thereof. In some examples, X comprises a polymeric backbone, comprising a plurality of repeating units, each of which is covalently bonded to (Y—[Z—F]$_m$), with Y, Z, F and m as described herein. X may be selected from a group selected from a branched or straight-chain $C_{1-5}$ alkyl (e.g., methyl), phenyl, methylene bisphenyl, trisphenylmethane, cyclohexane, or isocyanurate.

In some examples, Y is selected from a single bond, —O—, —C(═O)—O—, or —O—C(═O)—, m is 1, and X is an organic group selected from alkylene (e.g., 01-6 alkylene), optionally substituted alkylene (e.g., $C_{1-6}$ alkylene), aryl (e.g., $C_{5-12}$ aryl), optionally substituted aryl (e.g., $C_{5-12}$ aryl), arylalkyl (e.g., $C_{6-20}$ arylalkyl), optionally substituted arylalkyl (e.g., $C_{6-20}$ arylalkyl), alkylaryl (e.g., $C_{6-20}$ alkylaryl) and optionally substituted alkylaryl (e.g., $C_{6-20}$ alkylaryl). In some examples, Y is selected from a single bond, —O—, —C(═O)—O—, or —O—C(═O)—, m is 1, and X is an organic group selected from alkylene, aryl, arylalkyl, and alkylaryl. In some examples, Y is selected from a single bond, —O—, —C(═O)—O—, or —O—C(═O)—, m is 1, and X is an organic group selected from $C_{1-6}$ alkylene, $C_{5-12}$ aryl, $C_{6-20}$ arylalkyl, and $C_{6-20}$ alkylaryl. In some examples, Y is selected from a single bond, —O—, —C(═O)—O—, or —O—C(═O)—, m is 1, and X is an organic group selected from $C_{1-6}$ alkylene (e.g., methylene), phenyl, methylene bisphenyl, trisphenylmethane, and cyclohexane.

In some examples, X is selected from (i) an alkane, which may be an optionally substituted straight chain, branched chain or cyclo-alkane, (ii) a cyclo alkane having at least two substituents that are Y—[Z—F]$_m$ and (iii) an aryl (such as phenyl). In some examples, X is selected from (i) a branched alkane, with at least two of the alkyl branches covalently bonded to (Y—[Z—F]$_m$) and (ii) a cyclo alkane having at least two substituents that are Y—[Z—F]$_m$ and (iii) an aryl (such as phenyl) having at least two substituents that are Y—[Z—F]$_m$; Y is selected from (i) —O—, —C(═O)—O—, or —O—O(═O)— and m is 1 or (ii) Y is —$NH_{2-m}$, wherein m is 1 or 2; Z is $C_{1-4}$ alkylene; F is an epoxide of the formula —CH(O)CR$^1$H, wherein R$^1$ is selected from H and methyl, and in some examples, F is an epoxide of the formula —CH(O)CR$^1$H in which R$^1$ is H.

In some examples, Z—F is an epoxycycloalkyl group. In some examples, Z—F is an epoxycyclohexyl group. In some examples, Z—F is an epoxycyclohexyl group, in some examples, a 3,4-epoxycyclohexyl group. In some examples, the cross-linking agent comprises two epoxycycloalkyl groups, in some examples, two epoxycyclohexyl groups.

In some examples, the cross-linking agent comprises two epoxycycloalkyl groups, which are bonded to one another via a linker species; and the linker species may be selected from a single bond, optionally substituted alkyl, optionally substituted aryl, optionally substituted arylalkyl, optionally substituted alkylaryl, isocyanurate, a polysiloxane, —O—, —C(═O)—O—, —O—C(═O)—, and amino and combinations thereof. In some examples, the linker species may be selected from alkylene, —O—, —C(═O)—O— and —O—C(═O)—. In some examples, the linker species may be selected from —C(═O)—O— and —O—C(═O)—.

In some examples, the epoxy-based cross-linking agent is selected from the DECH family of epoxy-based cross-linking agents (including 3,4-epoxycyclohexylmethyl 3,4-epoxycyclohexanecarboxylate and 7-oxabicyclo[4.1.0]hept-3-ylmethyl 7-oxabicyclo[4.1.0]heptane-3-carboxylate) and tris(4-hydroxyphenyl)methane triglycidyl ether. In some examples, the epoxy-based cross-linking agent is selected from 3,4-epoxycyclohexylmethyl 3,4-epoxycyclohexanecarboxylate and 7-oxabicyclo[4.1.0]hept-3-ylmethyl 7-oxabicyclo[4.1.0]heptane-3-carboxylate, in some examples, 7-oxabicyclo[4.1.0]hept-3-ylmethyl 7-oxabicyclo[4.1.0]heptane-3-carboxylate.

In some examples, the epoxy-based cross-linking agent comprises an epoxidized novolac resin, for example, an epoxidized ortho-cresylic novolac resin. A novolac resin is a resin formed from the reaction of phenol or substituted phenol with formaldehyde. In some examples, the epoxy-based cross-linking agent is of the formula:

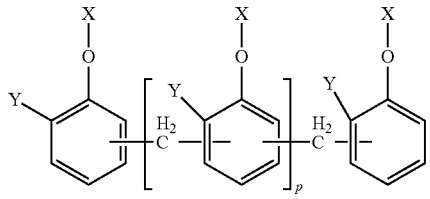

wherein X is a group comprising an epoxy group, for example, of the formula —[Z—F] wherein, in each [Z—F], Z and F are each independently selected, such that F is an epoxy group, for example, of the formula —CH(O)CR$^1$H, wherein R$^1$ is selected from H and alkyl;

Z is alkylene, for example, —$CH_2$—

Y is selected from H and a substituent, for example, an alkyl substituent, such as methyl and p is 0 or an integer, for example, an integer from 1 to 10;

and, in some examples, each Y is methyl, each X is —[$CH_2$—CH(O)$CH_2$], and p is 0 to 10, in some examples, 1 to 10, in some examples, 2 to 8.

In some examples, the cross-linking agent is an aziridine-based cross-linking agent, for example, a polyaziridine. The term 'polyaziridine' is used herein to refer to a molecule comprising at least two aziridine groups, for example, of the formula —N($CH_2$CR$^2$H), wherein R$^2$ is selected from H and alkyl (e.g., methyl), in some examples, wherein R$^2$ is methyl.

In some examples, the aziridine-based cross-linking agent is of the formula (II):

$$(S)\text{-}(T\text{-}[W\text{—}V]_i)_k$$

wherein, in each (T-[W—V]$_i$), T, W and V are each independently selected, such that V is an aziridine group, for example, of the formula —N($CH_2$CR$^2$H), wherein R$^2$ is selected from H and alkyl;

W is alkylene,

T is selected from (i) a single bond, —O—, —C(═O)—O—, or —O—C(═O)— and i is 1 or (ii) T is $NH_{2-i}$, wherein i is 1 or 2, k is at least 1, in some examples, at least 2, in some examples, at least 3, in some examples, 1-4, in some examples, 2-4, and S is an organic group.

In some examples, the cross-linking agent of formula (II) has at least two V groups, in some examples, at least three V groups.

In some examples, V is an aziridine of the formula —N($CH_2$CR$^2$H) in which R$^2$ is alkyl, in some examples, R$^2$ is methyl.

S may comprise or be an organic group selected from optionally substituted alkylene, optionally substituted alkyl, optionally substituted aryl, optionally substituted arylalkyl, optionally substituted alkylaryl, isocyanurate, and a polysiloxane. S may comprise a polymeric component; in some examples, the polymeric components may be selected from a polysiloxane (such as poly(dimethyl siloxane), a polyalkylene (such as polyethylene or polypropylene), an acrylate (such as methyl acrylate) and a poly(alkylene glycol) (such as poly(ethylene glycol) and poly(propylene glycol)), and combinations thereof. In some examples, S comprises a polymeric backbone, comprising a plurality of repeating units, each of which is covalently bonded to (T-[W—V]$_i$), with T, W, V and i as described herein. S may be selected from a group selected from a branched or straight chain $C_{1-12}$ alkyl (e.g., $C_{1-6}$).

In some examples, S is a branched-chain alkyl (e.g., trimethyl propane) in which each of the alkyl branch groups (e.g., each of the methyl groups when S is trimethyl propane) are substituted with a (T-[W—V]$_i$) group (i.e., k is 3 when S is trimethyl propane), in which T is selected from —O—, —C(═O)—O—, or —O—C(═O)—, in some examples, —O—C(═O)—; i is 1; W is $C_{1-4}$ alkylene, in some examples, methylene (—$CH_2$—) or ethylene (—$CH_2$—$CH_2$—), in some examples, ethylene; and V is an aziridine group of the formula —N($CH_2$CR$^2$H) in which R$^2$ is alkyl, in some examples, methyl.

In some examples, the aziridine-based cross-linking agent is trimethylolpropane tris(2-methyl-1-azridinepropionate) (XAMA®-2).

In some examples, the cross-linking agent is an isocyanate-based cross-linking agent, for example, a polyisocyanate. The term 'polyisocyanate' is used herein to refer to a molecule comprising at least two isocyanate groups, for example, of the formula —NCO.

In some examples, the isocyanate-based cross-linking agent is selected from polymethylene diphenyl isocyanates, biuret, hexamethylene diisocyanate trimer (trimer of HDI), uretdion dimer (Alipa), blocked isocyanates (Cytec, Bayer, Alipa) and aliphatic polyisocyanates.

In some examples, the isocyanate-based cross-linking agent is selected from polymethylene diphenyl isocyanates (e.g., Papi27 (Dow), Desmodur44V20 (Bayer), Suprasec5024 (Huntsman)), biuret, hexamethylene diisocyanate trimer (trimer of HDI), uretdion dimer (Alipa), blocked isocyanates (Cytec, Bayer, Alipa), aliphatic polyisocyanates, tolylene diisocyanate, diphenylmethane diisocyanate, naphthalene diisocyanate, xylylene diisocyanate, hydrogenated xylylene diisocyanate, hexamethylene diisocyanate, trimethylhexamethylene diisocyanate, isophorone diisocyanate, methylene-bis(4-cyclohexyl isocyanate),

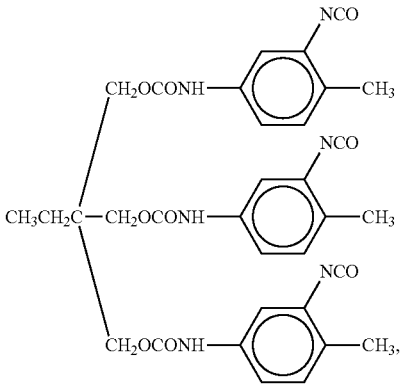

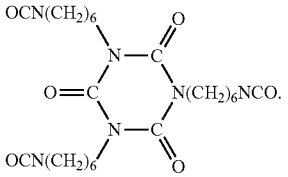

In some examples, the cross-linking agent is a carbodiimide-based cross-linker, for example, a polycarbodiimide. The term 'polycarbodiimide' is used herein to refer to a molecule comprising at least two carbodiimide groups, for example, of the formula —NCN—.

In some examples, the carbodiimide-based cross-linking agent is SV-02 Carbodilite.

In some examples, the cross-linking agent is selected from organic metallic complexes or ions, for example, ionomers and $Zn^{2+}$, $Ca^{2+}$ containing compounds.

In some examples, the cross-linking agent comprises a maleic anhydride, for example, the cross-linking agent may be a maleic anhydride-based cross-linking agent. In some examples, the cross-linking agent is a polymaleic anhydride.

In some examples, the maleic anhydride-based cross-linking agent is of formula (III):

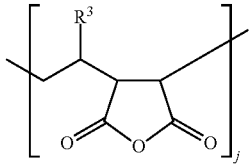

in which $R^3$ is H or alkyl and j is greater than 1.

In some examples, j is greater than 10, in some examples, greater than 100.

In some examples, $R^3$ is H or $C_{1-20}$ alkyl (e.g., $C_{16}$ alkyl).

In some examples, the maleic anhydride-based cross-linking agent is polymaleic anhydride 1-octadecene (available from Polyscience), poly(ethylene-alt-maleic anhydride) (available from Sigma).

In some examples, the cross-linking agent may comprise an anhydride. In some examples, the cross-linking agent is an anhydride-based cross-linking agent, for example, a cross-linking agent comprising the group —C(O)OC(O)—.

In some examples, the anhydride-based cross-linking agent is a cyclic anhydride, in some examples, a cyclic anhydride of formula (IV):

$$R^4C(O)OC(O)R^5$$

in which $R^4$ and $R^5$ are linked to form an optionally substituted ring.

In some examples, the anhydride-based cross-linking agent is glutaric anhydride or phthalic anhydride.

In some examples, the cross-linking agent comprises a polyanhydride, for example, polyacrylic anhydride or polymethacrylic anhydride.

In some examples, the cross-linking agent comprises an aldehyde. In some examples, the cross-linking agent is an aldehyde-based cross-linking agent, for example, a polyaldehyde. The term 'polyaldehyde' is used herein to refer to a molecule comprising at least two aldehyde groups, for example, of the formula —C(O)H.

In some examples, the cross-linking agent comprises a ketone. In some examples, the cross-linking agent is a ketone-based cross-linking agent, for example, a polyketone. The term 'polyketone' is used herein to refer to a molecule comprising at least two ketone groups.

In some examples, the cross-linking agent comprises an acetyl acetonate. In some examples, the cross-linking agent is an acetyl acetonate based cross-linking agent, for example, acetoacetoxyethyl methacrylate (Eastman™ AAEM).

In some examples, the cross-linking agent comprises an organosilane, for example, a cross-linking agent comprising a silane group. In some examples, the organosilane may be of the formula $R'Si(R^6)(R^7)(R^8)$ wherein $R^6$, $R^7$ and $R^8$ are independently selected from optionally substituted alkoxy, optionally substituted alkyl and optionally substituted aryl; and R' is selected from optionally substituted alkoxy, optionally substituted alkyl (e.g., aminoalkyl) and optionally substituted aryl. In some examples, $R^6$, $R^7$ and $R^8$ are all alkyl, for example, methyl. In some examples, R' is optionally substituted alkyl, for example, amino substituted alkyl (e.g., $C_{1-12}$ aminoalkyl), or isocyanate substituted alkyl. In some examples, R' is $C_{1-6}$ aminoalkyl (e.g., aminopropyl).

In some examples, the cross-linking agent comprises trimethylaminopropylsilane.

In some examples, the cross-linking agent comprises an epoxyorganosilane, for example, a cross-linking agent comprising a silane group (e.g., a group of formula —Si($R^6$)($R^7$)($R^8$) as described above) and an epoxy group as described above.

In some examples, the cross-linking agent comprises an epoxyorganosilane selected from epoxypropyltrimethoxysilane and oligomeric polyepoxysilane.

In some examples, the cross-linking composition comprises, consists essentially of or consists of 2,4-epoxycyclohexylmethyl (DECH) in an amount of 1-5 wt. % in a carrier solvent. In some examples, the cross-linking composition comprises, consists essentially of or consists of 7-oxabicyclo[4.1.0]heptane-3-carboxylic acid and/or 7-oxabicyclo[4.1.0]hept-3-ylmethyl ester in an amount of 5-20 wt. % in a carrier solvent. In some examples, the cross-linking composition comprises, consists essentially of or consists of trimethylpropane tris(2-methyl-1-aziridinepropionate) (XAMA 2) in an amount of 1-15 wt. % in a carrier solvent. In some examples, the cross-linking composition comprises, consists essentially of or consists of tris(4-hydroxyphenyl)methane triglycidyl ether in an amount of 1 wt. % in a carrier solvent. In some examples, the cross-linking composition comprises, consists essentially of or consists of a carbodiimide cross-linking agent in an amount of 1-10 wt. % in a carrier solvent.

Over Print Varnish (OPV)

In some examples, an over print varnish (OPV) may be applied after the cross-linking agent has been activated, forming an over print varnish layer. In some examples, an over print varnish may be applied after the application of the cross-linking composition but before the cross-linking agent has been activated. In some examples, the over print varnish may comprise an over print varnish resin and an over print varnish solvent. In some examples, the over print varnish solvent may be a carrier solvent as described above.

In some examples, the printed label may comprise an over print varnish that has been applied after the cross-linking agent has been activated. In some examples, the printed label may comprise an over print varnish that has been applied before the cross-linking agent has been activated.

In some examples, the over print varnish is a water-based over print varnish (e.g., an over print varnish comprising an over print varnish resin dispersed in water), a solvent-based over print varnish (e.g., an over print varnish comprising an over print varnish resin dissolved or dispersed in an organic solvent, such as ethyl acetate, n-propanol or ethanol), a UV-curable over print varnish (e.g., an over print varnish comprising a UV-curable over print varnish resin and a photo-initiator) or an electron beam over print varnish. Suitable over print varnishes are standardly used over print varnishes.

In some examples, the over print varnish comprises an over print varnish resin.

In some examples, the over print varnish is selected from a water-based over print varnish comprising acrylate resin or polyurethane resin; a solvent-based over print varnish comprising nitrocellulose resin or polyurethane resin; and a UV-curable over print varnish comprising acrylate resin or polyurethane resin.

In some examples, the over print varnish is deposited on the label substrate such that the coat weight of the over print varnish resin on the label substrate is in the range of about 0.5 g/$m^2$ to about 10 g/$m^2$, in some examples about 1 g/$m^2$ to about 5 g/$m^2$.

Over Print Varnish Resin

In some examples, the overprint varnish comprises an over print varnish resin and an over print varnish solvent.

In some examples, an over print varnish comprising an over print varnish resin is applied after the cross-linking agent has been activated, forming an over print varnish layer disposed on the cross-linked substrate formed from the printed layer, primer layer and label substrate.

In some examples, the over print varnish resin comprises an acrylate resin, a polyurethane resin or a nitrocellulose resin. When the over print varnish resin comprises a polyurethane resin, the over print varnish resin may comprise a one component or a two component polyurethane resin.

In some examples, the over print varnish resin comprises at least one cross-linkable resin, which may be an unsaturated group. In some examples, the over print varnish resin may comprise unsaturated groups such as CN and/or C═O groups. In some examples, the over print varnish resin may comprise a polymer having a carboxyl functionality. In some examples, the over print resin may comprise a polymer having isocyanurate or isocyanate functionality. In some examples, the over print varnish comprises a cross-linkable functionality that forms an ester linkage on cross-linking. In some examples, the over print varnish resin may comprise a polymer selected from an acrylic or polyurethane based polymer. In some examples, the over print varnish resin may comprise a styrene-acrylic polymer or a polyurethane polymer.

In some examples, the over print varnish may be selected from ACTEGA ACTDigiles, Water Lac 1960 acrylic emulsion, Water Lac 1320 acrylic emulsion, PLASTOPRINT PM (polyurethane thermoplastic coating) AVCO CHEMICALS LTD, AVCOPRINT ABZ-500 styrene (acrylic based) AVCO CHEMICALS LTD, AVCOPRINT SAZSPSYNTOPRET OL-V (thermoplastic polyurethane) AVCO CHEMICALS LTD, AVCOPRINT SAZ (acrylic based) AVCO CHEMICALS LTD, and Pulse IV 018 Matt UV OPV (Pulse Roll Label Products Ltd.).

Method

Described herein is a method for producing a printed label comprising: providing a label substrate having a first and second surface, wherein the first and second surfaces form opposing surfaces of the label substrate; applying a primer comprising a cross-linkable primer resin onto the first surface of the label substrate to form a primer layer; electrophotographically printing onto the primer layer an electrostatic ink composition comprising a cross-linkable thermoplastic resin to form a printed layer; applying a cross-linking composition comprising a cross-linking agent to the printed layer, wherein the cross-linking agent penetrates into the electrostatic ink composition and the primer layer; and activating the cross-linking agent; wherein an adhesive is present on the second surface of the label substrate or is applied to the second surface of the label substrate at any point in the method.

Figure 2:
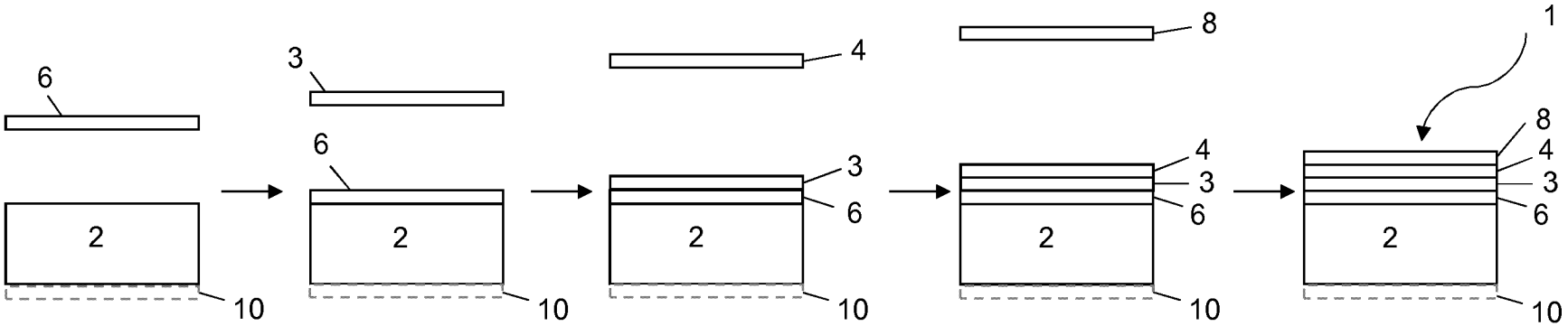
FIG. 2 shows schematically another example of a method for producing a printed label.

Examples of the method described herein are depicted schematically in FIGS. 1 and 2, in which the following reference numerals are used to identify the features indicated: reference numeral "1" denotes a printed label; reference numeral "2" denotes a label substrate having a first surface and a second surface; reference numeral "6" denotes a primer; reference numeral "3" denotes an electrostatic ink composition; reference numeral "4" denotes a cross-linking composition, reference numeral "8" denotes an over print varnish and reference numeral "10" denotes an adhesive that may be applied to the second surface of the label substrate at any stage of the method or may be part of the label substrate prior to commencement of the method.

FIG. 1 depicts a method in which a label substrate 2 having a first surface and a second surface is provided and a primer 6 comprising a primer resin is applied onto the first surface thereof, providing a primer layer disposed on the first surface of a label substrate 2. An electrostatic ink composition 3 comprising a thermoplastic resin is printed onto the primer layer, providing a printed layer disposed on the primer layer.

A cross-linking composition 4 comprising a cross-linking agent is then applied onto the printed electrostatic ink composition 3, that is, onto the printed layer. In some examples, the cross-linking agent of the cross-linking composition 4 penetrates into the electrostatic ink composition and the primer layer The cross-linking agent in the cross-linking composition is then activated causing cross-linking. In some examples, the activation of the cross-linking agent causes cross-linking of the thermoplastic resin of the electrostatic ink composition within the printed layer. In some examples, the activation of the cross-linking agent causes cross-linking of the thermoplastic resin of the electrostatic ink composition within the printed layer and to the primer resin of the primer in the primer layer. In some examples, activation of the cross-linking agent causes cross-linking of the thermoplastic resin of the electrostatic ink composition within the printed layer and to the primer resin of the primer in the primer layer and within the primer layer.

In some examples, the primer 6 comprising a primer resin is applied on the label substrate in an amount such that the coat weight of the primer resin in the primer layer measured over the area of the first surface of the label substrate is at least 0.01 g/m$^2$, in some examples, at least 0.05 g/m$^2$, in some examples, at least 0.1 g/m$^2$, in some examples, at least 0.15 g/m$^2$, in some examples, about 0.18 g/m$^2$. In some examples, the primer is applied in an amount such that the coat weight of the primer resin in the primer layer measured over the area of the first surface of the label substrate is up to about 0.2 g/m$^2$, in some examples, up to about 0.5 g/m$^2$, in some examples, up to about 1 g/m$^2$, in some examples, up to about 1.5 g/m$^2$.

In some examples, the primer may be applied onto first surface of the label substrate by using any technique standardly used, for example, gravure coating, flexo coating, screen coating or electrophotographic printing. In some examples, the primer may be applied onto the first surface of the label substrate by using a process in-line with the printing of the electrostatic ink composition onto the surface of the label substrate on which the primer is applied.

In some examples, the method comprises applying a corona treatment to the surface of the label substrate before applying the primer onto the surface of the label substrate.

In some examples, the method comprises applying a corona treatment to the primer disposed on the surface of the label substrate before printing an electrostatic ink composition on to the primer layer.

In some examples, printing an electrostatic ink composition onto the primer layer, forming a printed layer, may comprise printing any electrostatic ink composition described herein on the primer layer by any suitable electrostatic printing process.

In some examples, printing an electrostatic ink composition onto the primer layer comprises printing an electrostatic ink composition, for example, a liquid electrostatic ink composition, onto the primer layer in an electrophotographic or electrostatic printing process by using an electrophotographic or electrostatic printing apparatus. Examples of suitable electrophotographic or electrostatic printing equipment are the HP Indigo digital presses. In some examples, the method may comprise electrophotographically printing a liquid electrophotographic ink composition onto the primer layer.

In some examples, an electrostatic ink composition comprising a thermoplastic resin is printed on the primer layer in an amount such that the coat weight of the thermoplastic resin in the printed layer measured over the area of the first surface of the primer layer is at least 0.01 g/m$^2$, in some examples, at least 0.05 g/m$^2$, in some examples, at least 0.1 g/m$^2$, in some examples, at least 0.5 g/m$^2$, in some examples, about 1 g/m$^2$. In some examples, the electrostatic ink composition is printed in an amount such that a coat weight of the thermoplastic resin in the printed layer measured over the area of the primer layer is up to about 16 g/m$^2$, in some examples, up to about 10 g/m$^2$, in some examples, up to about 5 g/m$^2$, in some examples, up to about 4 g/m$^2$.

In some examples, the method comprises applying a corona treatment to the printed layer formed from the electrostatic ink composition disposed on the primer layer before applying a cross-linking composition onto the printed layer formed from the electrostatic ink composition.

In some examples, the cross-linking composition may be applied to the printed layer disposed on the primer layer by using any suitable coating process. In some examples, the cross-linking composition is applied onto the printed layer by using a flexo coating, gravure, offset, or screen printing process. In some examples, the cross-linking composition is applied onto the printed layer by using a printing machine, in some examples, the cross-linking composition is applied onto the printed layer by using a laminator.

In some examples, the cross-linking composition may be applied to the printed layer and primer layer disposed on the label substrate which may have been left exposed after printing of the ink composition onto the primer layer on a surface of the label substrate.

In some examples, applying the cross-linking composition on to the printed layer comprises depositing a cross-linking composition comprising a cross-linking agent for cross-linking the thermoplastic resin of the electrostatic ink composition. In some examples, applying the cross-linking composition on to the printed layer comprises applying a cross-linking composition comprising a cross-linking agent for cross-linking the thermoplastic resin of the electrostatic ink composition and a cross-linking agent for cross-linking the primer resin of the primer. In some examples, applying the cross-linking composition on to the printed ink composition comprises applying a cross-linking composition comprising a cross-linking agent for cross-linking the thermoplastic resin of the electrostatic ink composition and for cross-linking the primer resin of the primer. In some examples, applying the cross-linking composition on to the printed ink composition may comprise applying a cross-linking composition for cross-linking the thermoplastic resin of the electrostatic ink composition and applying an additional cross-linking composition comprising a cross-linking agent for cross-linking the primer resin of the primer.

In some examples, the cross-linking composition is applied on the printed layer in an amount such that the coat weight of the cross-linking agent measured over the area of the first surface of the label substrate is at least 0.01 g/m$^2$, in some examples, at least 0.02 g/m$^2$, in some examples, at least 0.03 g/m$^2$, in some examples, at least 0.04 g/m$^2$, in some examples, at least 0.05 g/m$^2$, in some examples, at least 0.06 g/m$^2$, in some examples, at least 0.08 g/m$^2$, in some examples, at least 0.1 g/m$^2$, in some examples, at least 0.12 g/m$^2$, in some examples, at least 0.15 g/m$^2$, in some examples, at least 0.18 g/m$^2$, in some examples, at least about 0.2 g/m$^2$, in some examples, at least about 0.3 g/m$^2$, in some examples, at least about 0.4 g/m$^2$, and in some examples, at least 0.5 g/m$^2$.

In some examples, the cross-linking composition is applied on to the printed layer in an amount such that the coat weight of the cross-linking agent measured over the area of the first surface of the label substrate is up to about 0.3 g/m$^2$, in some examples, up to about 0.4 g/m$^2$, in some examples, up to about 0.8 g/m$^2$, and in some examples, up to about 1 g/m$^2$.

In some examples, the cross-linking composition is applied on the printed layer in an amount such that the coat weight of the cross-linking agent measured over the area of the first surface of the label substrate is from about 0.04 to about 0.8 g/m$^2$, in some examples, from about 0.04 to about 0.4 g/m$^2$, and in some examples, from about 0.04 to about 0.3 g/m$^2$.

In some examples, the method comprises applying a corona treatment to the printed label substrate before depositing the cross-linking composition on the label substrate.

In some examples, the method of producing a printed label comprises activating the cross-linking composition after application of the cross-linking agent on the printed layer disposed on the primer layer disposed on the label substrate. In some examples, activation of the cross-linking agent results in the formation of a cross-linked product of the cross-linking agent and the thermoplastic resin (i.e., a cross-linked thermoplastic resin). In some examples, activation of the cross-linking agent results in the formation of a cross-linked product of a cross-linking agent and the thermoplastic resin (i.e., a cross-linked thermoplastic resin) and a cross-linked product of a cross-linking agent and the primer resin (i.e., a cross-linked primer resin). In some examples, activation of the cross-linking agent results in the formation of a cross-linked product of a cross-linking agent and the thermoplastic resin (i.e., a cross-linked thermoplastic resin), a cross-linked product of a cross-linking agent and the primer resin (i.e., a cross-linked primer resin) and a cross-linked product of a cross-linking agent, the primer resin and the thermoplastic resin. In some examples, activation of the cross-linking agent results in the formation of a cross-linked product of a cross-linking agent and the thermoplastic resin (i.e., a cross-linked thermoplastic resin), a cross-linked product of a cross-linking agent and the primer resin (i.e., a cross-linked primer resin), a cross-linked product of a cross-linking agent, the primer resin and the thermoplastic resin and a cross-linked product of a cross-linking agent, the primer resin and the label substrate.

In some examples, the activation of the cross-linking agent is initiated and/or promoted by light (photoinitiation), such as ultraviolet light (UV photoinitiation); heat (thermal initiation); electron beam (e-beam initiation); ionising radiation, such as gamma radiation (gamma initiation); non-ionising radiation, such as microwave radiation (microwave initiation); or any combination thereof.

In some examples, activation of the cross-linking agent may comprise heating the cross-linking composition. In some examples, activation of the cross-linking agent comprises heating the cross-linking composition to evaporate a carrier solvent. In some examples, activation of the cross-linking composition comprises heating the cross-linking composition to a temperature of at least 50° C., in some examples, at least 60° C., in some examples, at least 70° C., in some examples, at least 80° C., in some examples, at least 90° C., in some examples, at least 100° C., in some examples, at least 110° C., in some examples, at least 120° C., and in some examples, up to about 200° C.

In some examples, the method comprises applying a corona treatment to the surface of the label substrate on which the cross-linking composition has been deposited before deposition of an over print varnish on the label substrate.

In some examples, the cross-linking agent is activated after deposition on the printed layer, which is disposed on the primer layer, which is disposed on the first surface of the label substrate.

In some examples, as shown in FIG. 2, after the cross-linking composition is applied to the printed layer, an over print varnish 8 is applied. In some examples, the cross-linking composition is activated prior to deposition of an over print varnish. In some examples, the cross-linking composition is activated after deposition of an over print varnish.

In some examples, an over print varnish may be deposited after application of a cross-linking composition, optionally after activation of the cross-linking composition, to further protect the electrostatic ink composition printed on the primer layer on the first surface of the label substrate. In some examples, the over print varnish may be deposited such that the over print varnish is disposed on the cross-linking composition which is disposed on the printed layer, which is disposed on the primer layer on the first surface of the label substrate. In some examples, the over print varnish may be deposited such that the over print varnish is disposed on the cross-linked printed ink composition of the printed layer. Deposition of the over print varnish onto the printed label substrate may take place by any suitable coating process, for example, flexo coating, gravure coating or screen printing.

In some examples, the method comprises:

providing a label substrate having a first surface and a second surface, wherein the first and second surfaces form opposing surfaces of the label substrate;

applying a primer comprising a cross-linkable primer resin (which may be as described herein, e.g., comprising an amine functional group) onto the first surface of the label substrate to form a primer layer;

electrophotographically printing onto the primer layer an electrostatic ink composition comprising a cross-linkable thermoplastic resin to form a printed layer, the cross-linkable thermoplastic resin comprising a polymer having acidic side groups; and applying a cross-linking composition comprising a cross-linking agent selected from an epoxy-based cross-linking agent, an aziridine-based cross-linking agent, an isocyanate-based cross-linking agent and a carbodiimide-based cross-linking agent onto the printed layer disposed on the primer layer, wherein the cross-linking agent penetrates into the electrostatic ink composition and the primer layer; and activating the cross-linking agent, wherein activating the cross-linking agent causes the thermoplastic resin of the electrostatic ink composition to be cross-linked, the primer resin of the primer to be cross-linked and the thermoplastic resin of the electrostatic ink composition to be cross-linked with the primer resin of the primer, wherein an adhesive is present on the second surface of the label substrate before or is applied during or after any one of these steps.

In some examples, the printed label comprises:

a label substrate having opposing first and second surfaces;

a primer layer disposed on the first surface of the label substrate, wherein the primer comprises a primer resin (which may be as described herein, e.g., comprising an amine functional group);

a printed layer disposed on the primer layer, wherein the printed layer comprises an electrostatic ink composition comprising a thermoplastic resin, the thermoplastic resin comprising a polymer having acidic side groups;

an adhesive layer disposed on the second surface of the label substrate; and wherein a cross-linking agent has been applied to the printed layer and allowed to penetrate into the electrostatic ink composition and the primer layer; and the cross-linking agent has been activated to cross-link the thermoplastic resin of the electrostatic ink composition and the primer resin of the primer layer;

wherein the cross-linking agent is selected from an epoxy-based cross-linking agent, an aziridine-based cross-linking agent, an isocyanate-based cross-linking agent and a carbodiimide-based cross-linking agent.

In some examples, the method comprises:

providing a label substrate having a first surface and a second surface, wherein the first and second surfaces form opposing surfaces of the label substrate;

applying a primer comprising a cross-linkable primer resin onto the first surface of the label substrate to form a primer layer (and the primer resin may be as described herein, e.g., comprising an amine functional group);

electrophotographically printing onto the primer layer an electrostatic ink composition comprising a cross-linkable thermoplastic resin to form a printed layer, the cross-linkable thermoplastic resin comprising a polymer having acidic side groups; and applying a cross-linking composition comprising a cross-linking agent to the printed layer, wherein the cross-linking agent comprises an epoxy-based cross-linking agent;

wherein the cross-linking agent penetrates into at least the electrostatic ink composition and the primer layer; and activating the cross-linking agent;

wherein an adhesive is present on the second surface of the label substrate before or is applied during or after any one of these steps.

In some examples, the printed label comprises:

a label substrate having opposing first and second surfaces;

a primer layer disposed on the first surface of the label substrate, wherein the primer comprises a primer resin (which may be as described herein, e.g., comprising an amine functional group);

a printed layer disposed on the primer layer, wherein the printed layer comprises an electrostatic ink composition comprising a thermoplastic resin, the thermoplastic resin comprising a polymer having acidic side groups;

an adhesive layer disposed on the second surface of the label substrate; and wherein a cross-linking agent has been applied to the printed layer and allowed to penetrate into the electrostatic ink composition and the primer layer;

the cross-linking agent has been activated to cross-link at least the thermoplastic resin of the electrostatic ink composition and the primer resin; and wherein the cross-linking agent comprises an epoxy-based cross-linking agent.

EXAMPLES

The following illustrates examples of the materials, methods and related aspects described herein. Thus, these examples should not be considered to restrict the present disclosure, but are merely in place to teach how to make examples of compositions of the present disclosure. As such, a representative number of compositions and their method of manufacture are disclosed herein.

Example 1

A metalized paper (Met-paper) (available from Fasson or Wausau) label in which a paper support layer has been coated such that the first surface of the label substrate is a metallic layer, the second, opposing, surface is an adhesive layer overlaid with a release layer was used as the label substrate in this example. A primer comprising a cross-linkable primer resin (Michelman DigiPrime® 050) was applied in a coat weight of 0.14 g/m$^2$ to the first surface of the label substrate by using the in-line priming system in an HP Indigo WS6600 digital printing press, forming a primer layer on the first surface of the label substrate. An image (printed layer) was electrostatically printed onto the primer layer by using an HP Indigo WS6600 digital printing press by using HP Indigo ElectroInk 4.5 as the liquid electrostatic ink composition comprising a cross-linkable thermoplastic resin (more specifically comprising Nucrel 699, a copolymer of ethylene and methacrylic acid, available from DuPont, and A-C 5120, a copolymer of ethylene and acrylic acid, available from Honeywell). A cross-linking composition consisting of 7-oxabicyclo[4.1.0]hept-3-ylmethyl 7-oxabicyclo[4.1.0]heptane-3-carboxylate (5% by weight) dissolved in ethyl acetate as the cross-linking agent was applied in a dry coat weight of 0.15 g/m$^2$ by using a LaboCombi 400 laminator using a 70 LCM anilox roller and a coat speed of 10 m/min. The cross-linking agent was activated in the LaboCombi laminator ovens at a temperature of 70° C., 100° C., or 120° C. Pulse IV 018 Matt UV OPV was applied as a UV-curable over print varnish by using an ABG Digicoat machine, which utilises flexo coating technology, by using a 200×40 anilox roller and a coat weight of 3.0 to 5.0 g/m$^2$ (dry) and a UV lamp at 100% power and a machine speed of 20 m/min.

Example 2

The method described in Example 1 was used with a metalized biaxially oriented polypropylene film (Met-BOPP) (available from Intercoat, Fasson or Wausau) label in which a BOPP support layer has been coated such that the first surface of the label substrate is a metallic layer, the second, opposing, surface is an adhesive layer overlaid with a release layer as the label substrate in this example.

Reference Examples 1 and 2

Reference Examples were performed by following the methods described in Examples 1 and 2 without applying the cross-linking composition.

Scratch Resistance Tests

The printed side of the printed labels was scratched with a Tungsten carbide nail (60 g load) and the debris (ink and varnish removed by the nail) was collected and weighed by using analytical scales (ASTM C217). The lower the weight of the debris, the more durable the printed material on the printed label. Three measurements were taken for each sample, and the average results are provided in Table 1.

TABLE 1

| Met-Paper | Removed weight [g] | Met-BOPP | Removed weight [g] |
|---|---|---|---|
| Reference Example 1 | 0.200 ± 0.012 | Reference Example 2 | 0.273 ± 0.016 |
| Example 1 | 0.167 ± 0.009 | Example 2 | 0.143 ± 0.007 |

These results show that the use of a cross-linking composition on the Met-BOPP label substrate provided a 40% improvement in the scratch resistance of the printed label. A 17% improvement is shown for the Met-Paper label substrate.

Water Resistance Tests

The water resistance was tested by following the standard chemical resistance test provided in ASTM F2250-03. The test was performed by placing 1 mL of water on the printed side of the printed label, placing a 3×3 cm glass on the water and waiting for 5 min. After the glass was removed, a cloth was used to rub the surface 20 times. The results of this test are provided in Table 2.

TABLE 2

| Met-Paper | Ink remaining after water resistance test |
|---|---|
| Reference Example 1 | 40% |
| Example 1 | 99% |

These results show that the use of a cross-linking composition on the Met-Paper label substrate results in a significant improvement in rub resistance after exposure to water, with only 1% of the ink being removed.

While the electrostatic ink compositions, methods and related aspects have been described with reference to certain examples, those skilled in the art will appreciate that various modifications, changes, omissions, and substitutions can be made without departing from the spirit of the disclosure. It is intended, therefore, that the electrostatic ink compositions, methods and related aspects be limited by the scope of the following claims. Unless otherwise stated, the features of any dependent claim can be combined with the features of any of the other dependent claims, and any other independent claim.

The invention claimed is:

1. A method of producing a printed label, the method comprising:

providing a label substrate having a first surface and a second surface, wherein the first and second surfaces form opposing surfaces of the label substrate;

applying a primer comprising a cross-linkable primer resin onto the first surface of a label substrate to form a primer layer;

electrophotographically printing onto the primer layer an electrostatic ink composition comprising a cross-linkable thermoplastic resin to form a printed layer;

applying a cross-linking composition comprising an epoxy-based cross-linking agent to the printed layer, wherein the epoxy-based cross-linking agent penetrates into the electrostatic ink composition and the primer layer, and wherein the epoxy-based cross-linking agent has the formula:

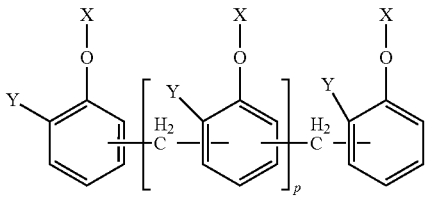

wherein X is a group including an epoxy group, Y is H or an alkyl; and p is an integer from 0 to 10;

activating the cross-linking agent; and applying an over print varnish over the cross-linking composition, wherein the over print varnish comprises a polymer having an isocyanurate functionality;

wherein an adhesive is present on the second surface of the label substrate when providing the label substrate, or wherein the adhesive is subsequently applied to the second surface of the label substrate at any point in the method.

2. The method according to claim 1, wherein the cross-linkable primer resin comprises a carboxylic functional group, an amine functional group or a polyol functional group.

3. The method according to claim 1, wherein the cross-linkable thermoplastic resin comprises a resin selected from the group consisting of alkylene acrylic acid resins, alkylene methacrylic acid resins, polyurethane resins, polyethylene imine resins, polyamide resins, polyvinyl alcohol, a polymer having acidic side groups, and combinations thereof.

4. The method according to claim 1, wherein the electrostatic ink composition is a liquid electrostatic ink composition.

5. The method according to claim 1, wherein the cross-linking composition does not contain any cross-linkable resin.

6. The method according to claim 1, wherein the cross-linking composition consists essentially of from 0.5 wt % to 30 wt % cross-linking agent by total weight of the cross-linking composition and from 70 wt % to 99.5 wt % carrier solvent.

7. The method according to claim 1, wherein the label substrate comprises paper and/or a polymeric film.

8. The method according to claim 1, wherein the adhesive is a pressure-sensitive adhesive, a heat-sensitive adhesive, a contact adhesive, a drying adhesive, a radiation-curing adhesive, or a moisture-curing adhesive.

9. The method according to claim 1, wherein the over print varnish is applied-after the activation of the cross-linking agent.

10. The method according to claim 1, wherein the over print varnish is applied after the application of the cross-linking composition and before the activation of the cross-linking agent.

11. The method according to claim 1, wherein the adhesive includes rubber-based hot melt composition or a solvent rubber adhesive.

12. The method according to claim 1, wherein the label substrate includes an acrylic substrate.

* * * * *